US005484102A

United States Patent [19]

DeMay

[11] Patent Number: 5,484,102

[45] Date of Patent: Jan. 16, 1996

[54] FOLDING CARTON BLANK WITH FEED GATE ENGAGING NOTCH

[75] Inventor: Karl F. DeMay, Newark, N.Y.

[73] Assignee: Fold-Pak Corporation, Newark, N.Y.

[21] Appl. No.: 198,993

[22] Filed: Feb. 18, 1994

Related U.S. Application Data

[63] Continuation-in-part of Ser. No. 974,975, Nov. 12, 1992, Pat. No. 5,288,012, which is a continuation-in-part of Ser. No. 796,758, Nov. 25, 1991, abandoned.

[51] Int. Cl.[6] ..... B65D 5/10

[52] U.S. Cl. ..... 229/132; 229/225; 229/900; 229/905; 229/935; 493/126; 493/131

[58] Field of Search ..... 229/132, 134, 229/136, 145, 146, 224, 225, 226, 227, 900, 905, 933, 935; 493/126, 127, 131, 132

*Primary Examiner*—Gary E. Elkins

*Attorney, Agent, or Firm*—Hopgood, Calimafde, Kalil & Judlowe

[57] ABSTRACT

A blank for forming a carton is provided. The blank comprises top, rear, bottom, front and cover panels hingedly connected in the order named. End wall-forming flaps are hingedly connected to left and right ends of the main panels. A feed gate engaging notch is formed on any of the eight (8) end wall-forming flaps to avoid smearing of printing ink during the finishing operation. All score lines, offset portions, perforations and breakaway features are formed in the same direction with reference to the paperboard stock.

32 Claims, 24 Drawing Sheets

FOLDING CARTON BLANK WITH FEED GATE ENGAGING NOTCH

BACKGROUND OF THE INVENTION

Related Applications

This is a continuation in part of application Ser. No. 974,975, filed Nov. 12, 1992, now U.S. Pat. No. 5,288,012, which is a continuation in part of application Ser. No. 796,758, filed Nov. 25, 1991 now abandoned.

FIELD OF INVENTION

The present invention generally relates to folding paperboard cartons and, more particularly, to an improved carton blank which eliminates ink-smearing problems during finishing operations.

BRIEF DESCRIPTION OF THE PRIOR ART

Folding cartons are well known in the packaging art. These cartons are constructed from flat blanks which are pre-cut and pre-scored on paperboard sheets. Carton blanks have four main panels which are adapted to form the top, rear, bottom and front of an assembled carton. Each panel has a pair of end flaps which are hingedly connected by score lines formed in the paperboard.

The blanks are folded once and secured with known adhesives to form carton sleeves which are used for packaging retail products, typically consumable goods. During the filling operation, packaging machinery is used to form and seal fully assembled cartons according to a prescribed folding sequence and adhesive pattern.

U.S. Pat. No. 4,712,730 describes a state-of-the-art carton blank used to assemble a rectangular, top opening carton. First and second ends of the carton are closed by folding the bottom panel end flaps first; front panel end flaps second; top panel end flaps third and rear panel end flaps fourth.

Prior to folding in the fourth down flap, single lines of adhesive are deposited on the bottom panel end flaps. All four end flaps are secured by single glue lines to form a smooth, continuous wall at first and second ends of the carton. Commercial products of the type described in U.S. Pat. No. 4,712,730 are manufactured and sold by Fold-Pak Corporation, Newark, N.Y. under the HI TECH® and HI TECH PLUS® trade designations.

According to art-recognized techniques, adhesive attachment of the end-wall forming flaps is difficult to achieve because overlapping end flaps are not co-planar in the folded condition. In specific terms, first-folded bottom panel end flaps are spatially removed from fourth-folded rear panel end flaps by intervening front and top panel end flaps. This spatial separation is generally characterized by a single or double thickness of paperboard stock.

U.S. Pat. No. 4,872,609 addresses this problem by describing raised portions formed in the bottom panel end flaps of a typical carton blank. These raised portions are substantially triangular in shape and operably associated with cutouts formed in the front panel end flaps of an assembled carton. According to this disclosure, the end wall-forming flaps are substantially co-planar so that fourth-folded rear panel end flaps are securely fastened to first-folded bottom panel end flaps with known adhesive patterns.

The offset portions of the prior art are raised from the bottom panel end flaps of a carton blank. They are formed in the paperboard stock by stamping the carton blanks in an upward, opposite direction with reference to the score lines and perforations. This procedure involves a reverse die-stamping operation which requires special make ready procedures and additional expense.

Carton blanks are produced from large paperboard sheets in a multiple configuration. Individual blanks are internally "nested" on three sides to minimize the amount of wasted paperboard. During the blanking operation, score lines are provided to facilitate the flap-folding sequence. Perforations are also cut in the paperboard to form art-recognized tear-away and breakaway features like those described in U.S. Pat. No. 4,712,689. Perforations and score lines are formed by die-cutting and die-stamping the carton blanks in a single, downward direction.

Adjacent blanks are frequently printed with different inks specified by various customers. To obtain a finished edge along the single-knife cuts, a bleed line is used to extend the ink from one blank onto an adjacent blank in areas that are not shown by a squared-up carton. During subsequent carton assembly, single stacks of cut, printed blanks enter finishing machines through a feed gate which uses the bleed line as the initial point of contact. This operation causes smearing of ink from the bleed lines as blanks pass through the feed gate.

Feed gate openings are typically adjusted to a single thickness of paperboard (approximately $1/24{,}000$ of an inch) to create a controlled entry point for one carton blank at a time. As the lowest blank in the stack passes enters the finishing equipment, bleed line ink is smeared by the action of the feed gate and the aggregate weight of the overlying blanks. The present invention eliminates this problem with an engaging notch formed on at least one main panel end flap of the carton blank.

OBJECTS OF THE INVENTION

Accordingly, it is a general object of the present invention to provide improvements in a carton for packaging materials.

It is another object of the present invention to provide a carton blank which is formed by a simplified, less expensive blanking operation.

It is yet another object of the present invention to provide an assembled carton with improved adhesion for the end wall-forming flaps.

It is another object of the present invention to provide a carton blank configuration which reduces the amount of paperboard stock required during the blanking operation.

Another object of the present invention is to provide a simplified carton blank with improved machinability characteristics.

It is yet another object of the present invention to provide a carton blank with better sealing and leakproof characteristics for the rear panel end flaps.

It is a further object of the present invention to provide a blank for forming a carton having a smoother, more aesthetically pleasing appearance at the ends of the carton.

Another object of the present invention is to provide a carton blank with a feed gate engaging notch formed on at least one main panel end flap.

A further object of the present invention is to provide a carton blank which eliminates ink smearing during the finishing operation.

Still further objects of the present invention will be apparent to those skilled in the relevant art.

SUMMARY OF THE INVENTION

The presently claimed invention is directed to a novel blank for assembling folding cartons, comprising bottom, front, top and rear panels. Each main panel has a left end flap and a right end flap. Score lines are disposed between the main panels and their respective end flaps. The top panel has score lines which define second and third fold lines which hingedly connect the left and right top end flaps, respectively.

The blank defined in the claims forms a carton which is closed by folding the end flaps according to a specific sequence bottom (1), front (2), top (3) and rear (4). The left and right bottom end flaps each have a free edge which engage the second and third fold lines of the top panel, respectively. The left and right front end flaps each have a free edge which also engage the second and third fold lines of the top panel, respectively.

The front, bottom, rear and top panels, hingedly connected by score lines, are adapted to form a corresponding sleeve which is readily converted into an open-ended carton, closed at one end, filled with a selected product and closed at the other end in a manner well-known in the art.

Optional lips or membranes are hingedly connected to the top edge of the front panel and front panel end flaps of the carton blank. The blank also includes a cover panel portion hingedly connected to the top panel and adapted to overlap the front panel. A releasable tear strip is formed in the cover panel portion by perforations in the paperboard stock.

Breakaway features may be formed in the rear panel end flaps to facilitate positive reclosure of an assembled carton during end-use application. Offset portions may be formed by die-stampings in the rear panel end flaps. When the flap-folding sequence is accomplished, these offset portions contact the bottom panel end flaps to provide adhesively secured end walls in an assembled carton. Offset portions, score lines, perforations and break-away features are preferably formed by die-cutting or die-stamping the carton blanks in a single, downward direction. This uniform operation eliminates special make ready procedures for reversing the die configuration used to form the raised or embossed portions of the prior art.

As an important aspect of the present invention, at least one main panel end flap has a feed gate engaging notch formed in the paperboard stock by conventional board cutting techniques. The preferred configuration is a broad "U-shaped" cut-out, approximately 1⅞ inches wide by 7/32 inch deep (for example, see FIG. 1, notch 71). A typical blank has a printed bleed line along the outer edge of an end flap and is approximately ⅛ inch deep.

Feed gates are provided on conventional finishing machines manufactured by Post Company, Nashua, New Hampshire. The typical feed gate configuration is a rectangular piece of metal approximately 1½ inches wide, 12 inches long and ¼ inch thick. It is usually adapted at the lower end with an angular, metal feed contact approximately 1½ inches wide.

Typical bleed lines are 16½ (1.5) inches wide and ⅛ (0.12) inch deep. Based on the relative dimensions of the feed gate, engaging notch and bleed line, the present invention avoids contact between the feed gate and bleed line, thereby eliminating the smearing problem described in this specification. Other relative dimensions for the engaging notch, feed gate and bleed line will be suitable depending on various end-use applications known in the art.

Reference is now made to the following detailed description of the preferred embodiments in connection with the accompanying drawings. Additional disclosure is provided by U.S. Pat. Nos. 4,712,689 and 4,712,730 which are incorporated by reference.

BRIEF DESCRIPTION OF THE DRAWINGS

FIGS. 19–25depict various embodiments having a feed gate notch on the respective right or left, bottom, front, rear and top end flaps.

DESCRIPTION OF THE PREFERRED EMBODIMENT

Figure 1:
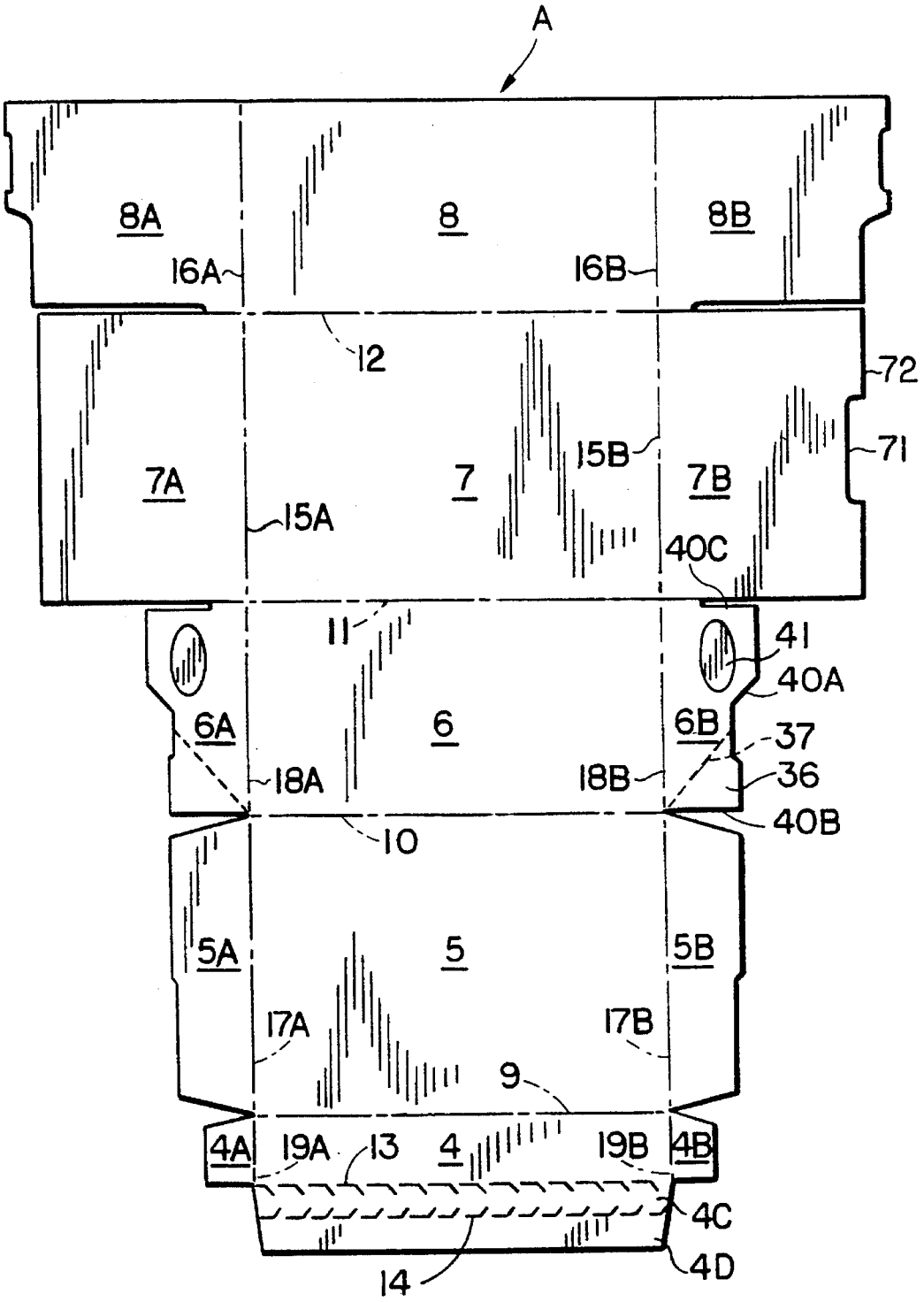
FIG. 1 is a plan view of a flat carton blank with the engaging notch formed in accordance with the preferred embodiment of the present invention.

Referring to the embodiment illustrated in FIG. 1, a carton blank generally designated A comprises cover panel 4, top panel 5, rear panel 6, bottom panel 7 and front panel 8 hingedly connected in the order named. More specifically, cover panel 4 and top panel 5 are hingedly connected by score line 9; top panel 5 and rear panel 6 are hingedly connected by score line 10; rear panel 6 and bottom panel 7 are hingedly connected by line 11 and bottom panel 7 and front panel 8 are hingedly connected by score line 12. Each score line is formed in the downward direction with reference to the upper surface of blank A. Along with other aspects of the present invention, score lines 9–12 permit simple manipulation of blank A to form an assembled carton for universal packaging of pre-selected products.

As shown generally in the drawings, cover panel 4 includes first and second end flaps 4A and 4B, intermediate tear-away strip 4C and front panel portion 4D. Strip 4C is defined by upper and lower die-cuts or perforations 13 and 14. Like score lines 9–12, die-cuts 13 and 14 are formed in a downward direction with reference to the upper surface of blank A. Tear-away strip 4C is releasably secured to front panel 4 by perforation 13 and releasably secured to front panel portion 4D by perforation 14.

Main panels 4–8 have first and second end flaps hingedly connected by adjacent fold lines. Specifically, first and second bottom panel end flaps 7A and 7B are hingedly connected to bottom panel 7 by intermediate fold lines 15A and 15B, respectively. In like terms, first and second front panel end flaps 8A and 8B are hingedly connected to front panel 8 by intermediate fold lines 16A and 16B; first and second top panel end flaps 5A and 5B are hingedly connected to top panel 5 by intermediate fold lines 17A and 17B; first and second rear panel end flaps 6A and 6B are hingedly connected to rear panel 6 by intermediate fold lines 18A and 18B; and first and second cover panel end flaps 4A and 4B are hingedly connected to cover panel 4 by intermediate fold lines 19A and 19B.

Figure 18:
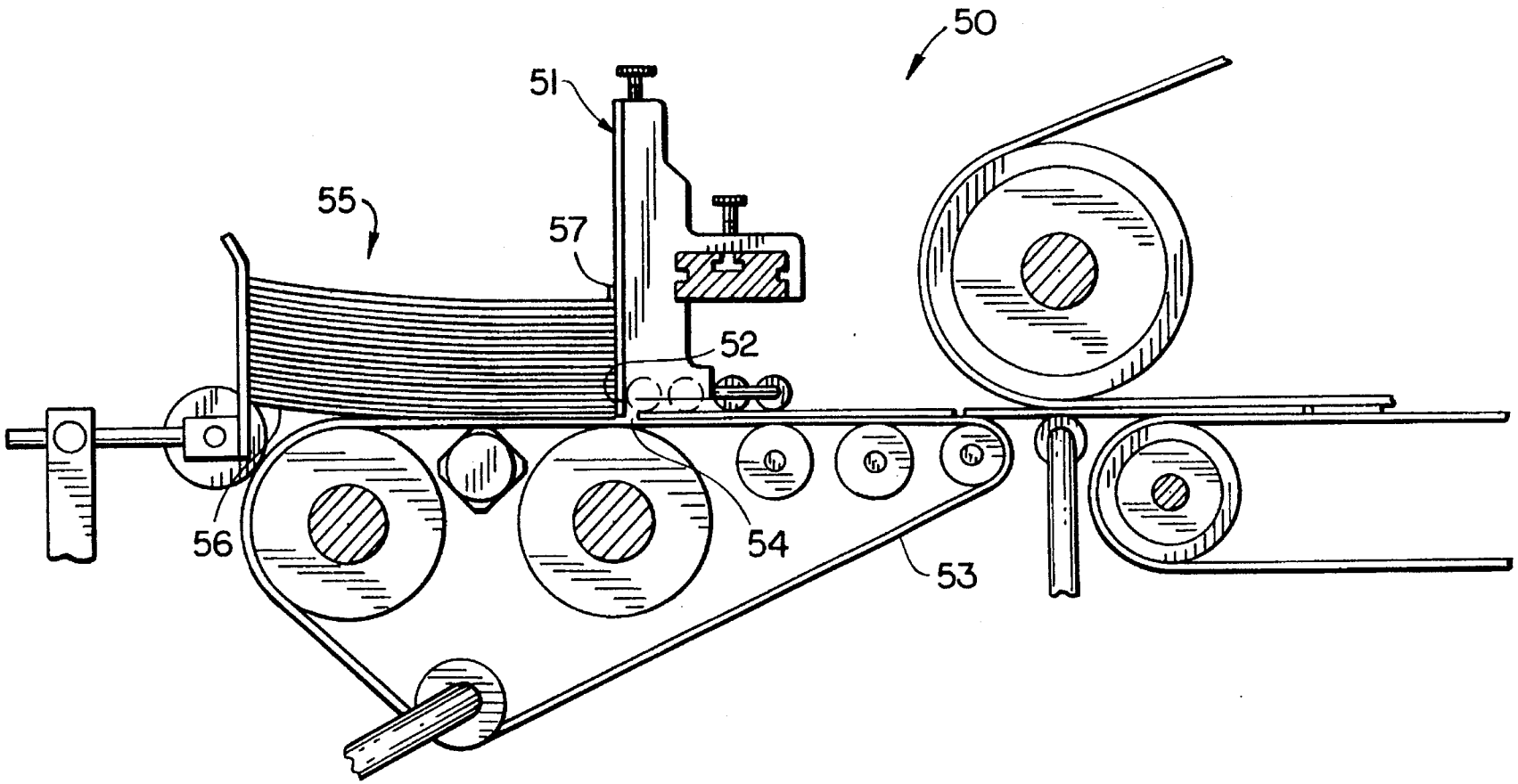
FIG. 18 shows a stack of foldable blanks entering the feed gate of a finishing machine used for processing foldable blanks.
Figure 19:
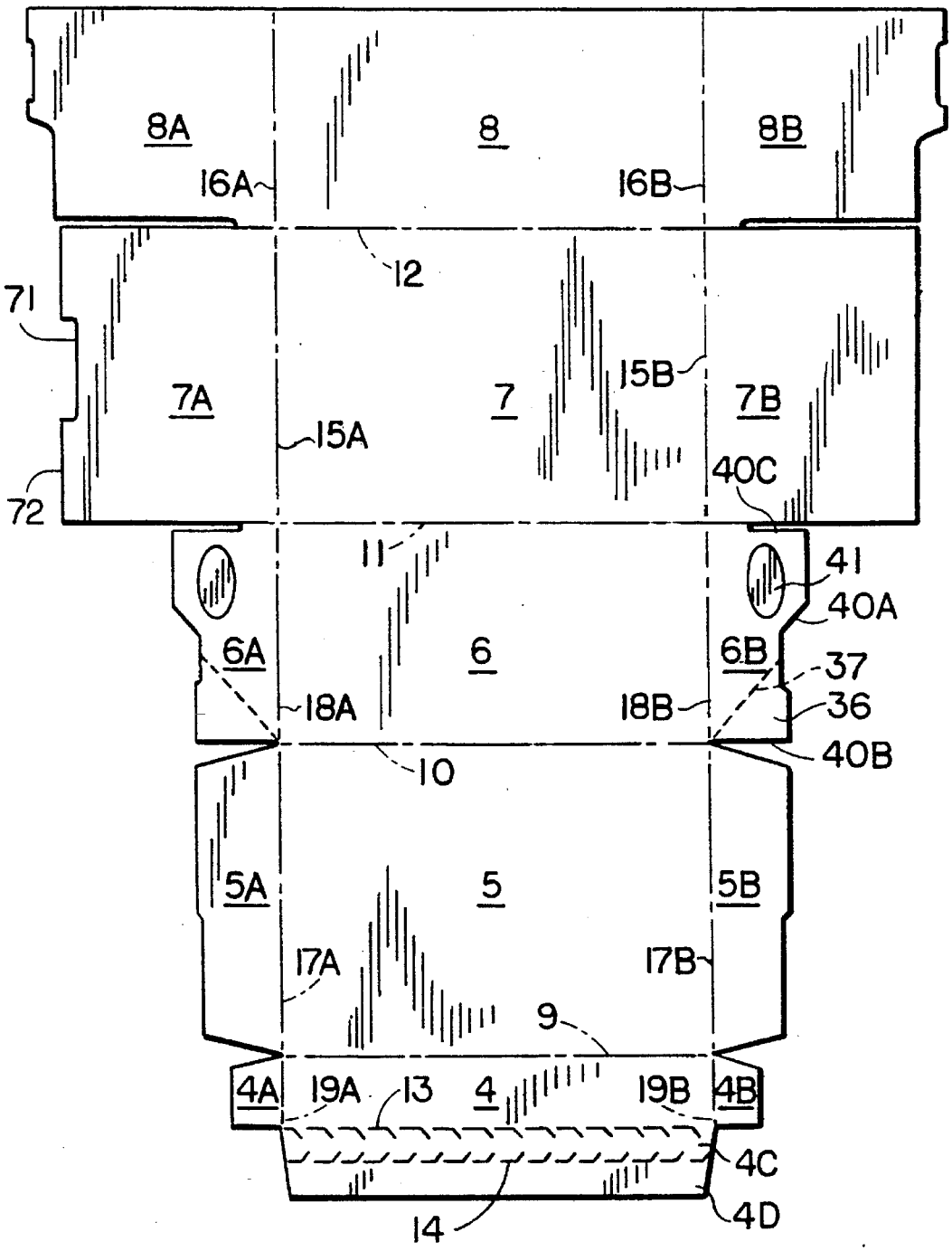
Figure 20:
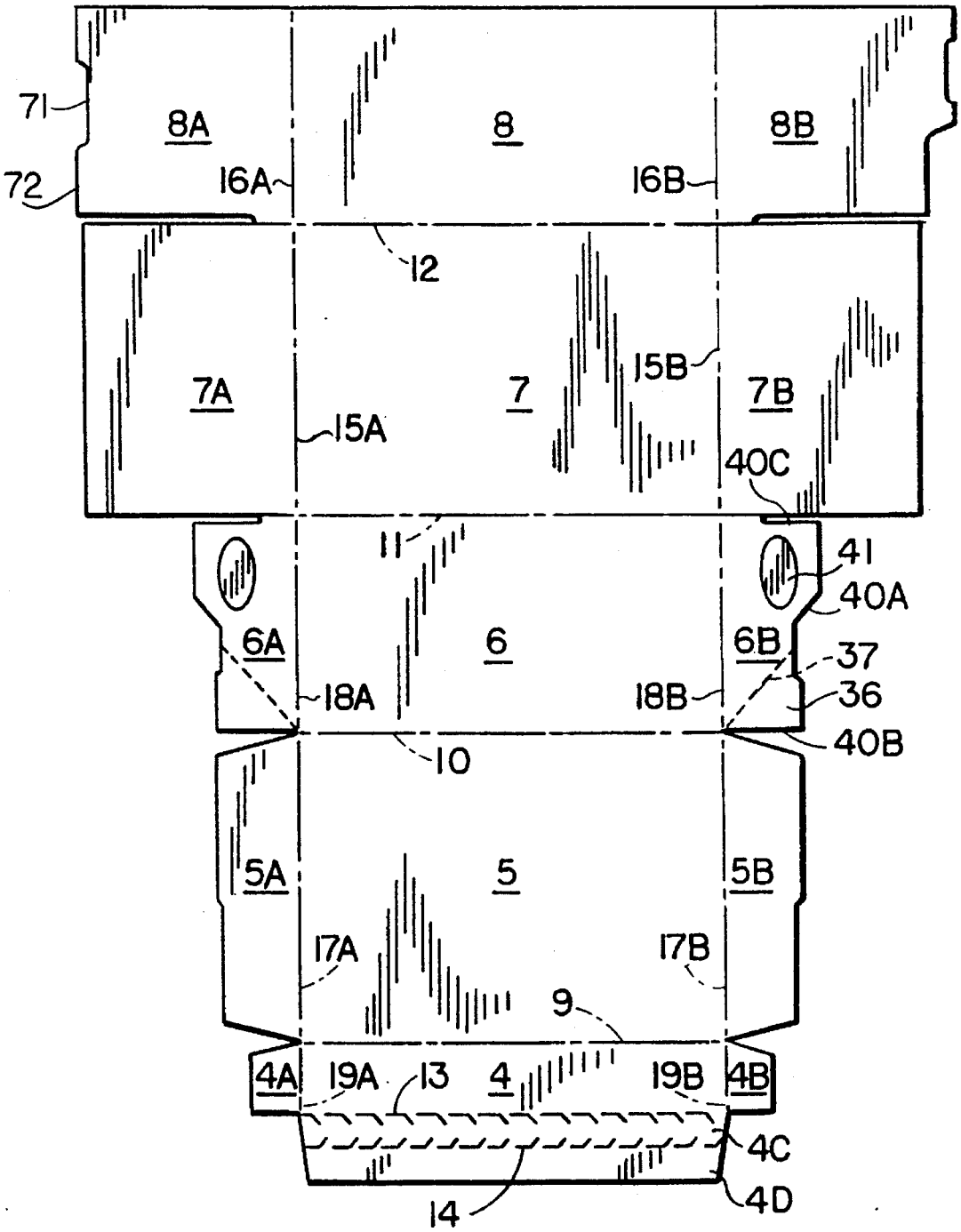
Figure 21:
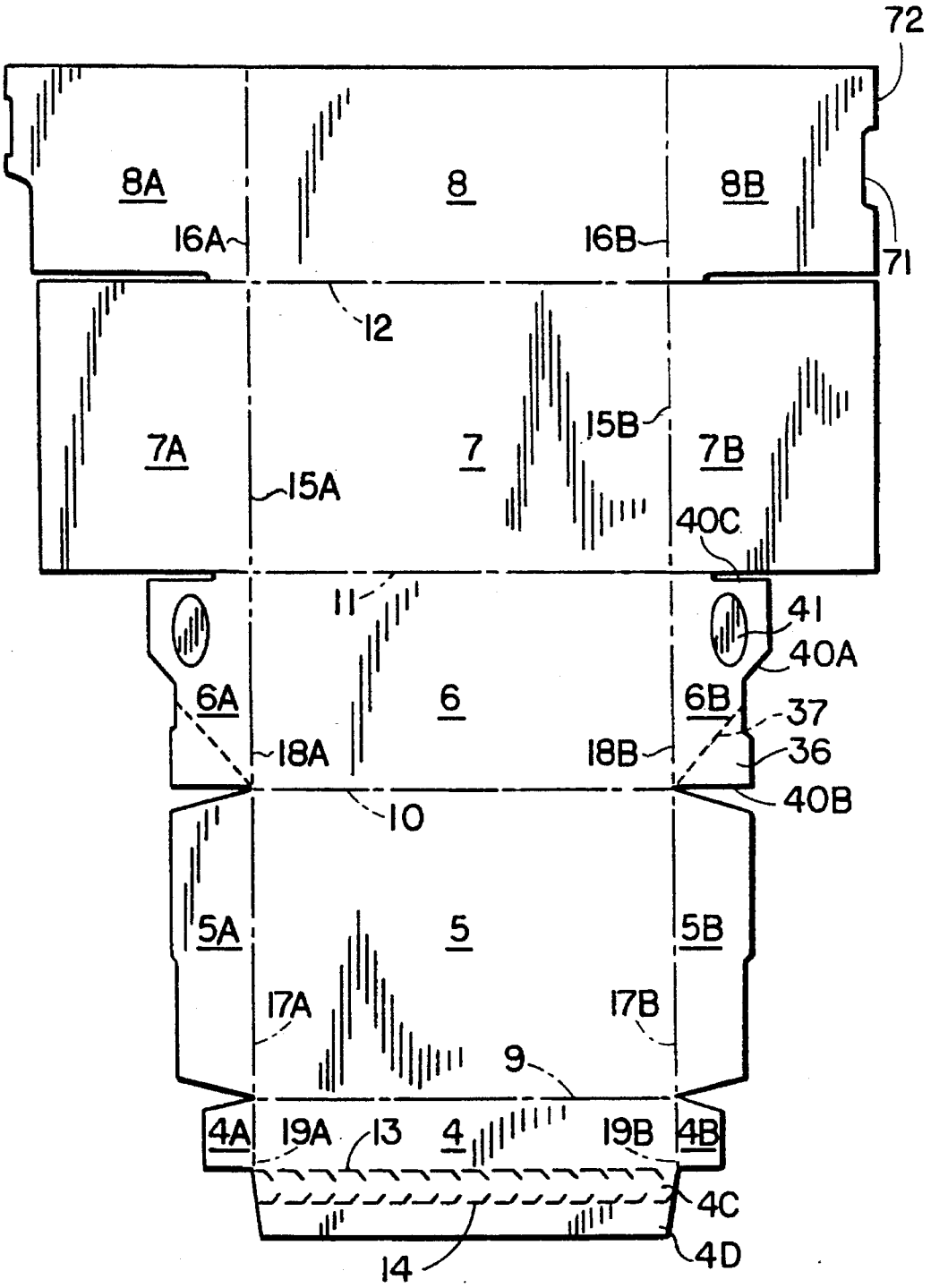
Figure 22:
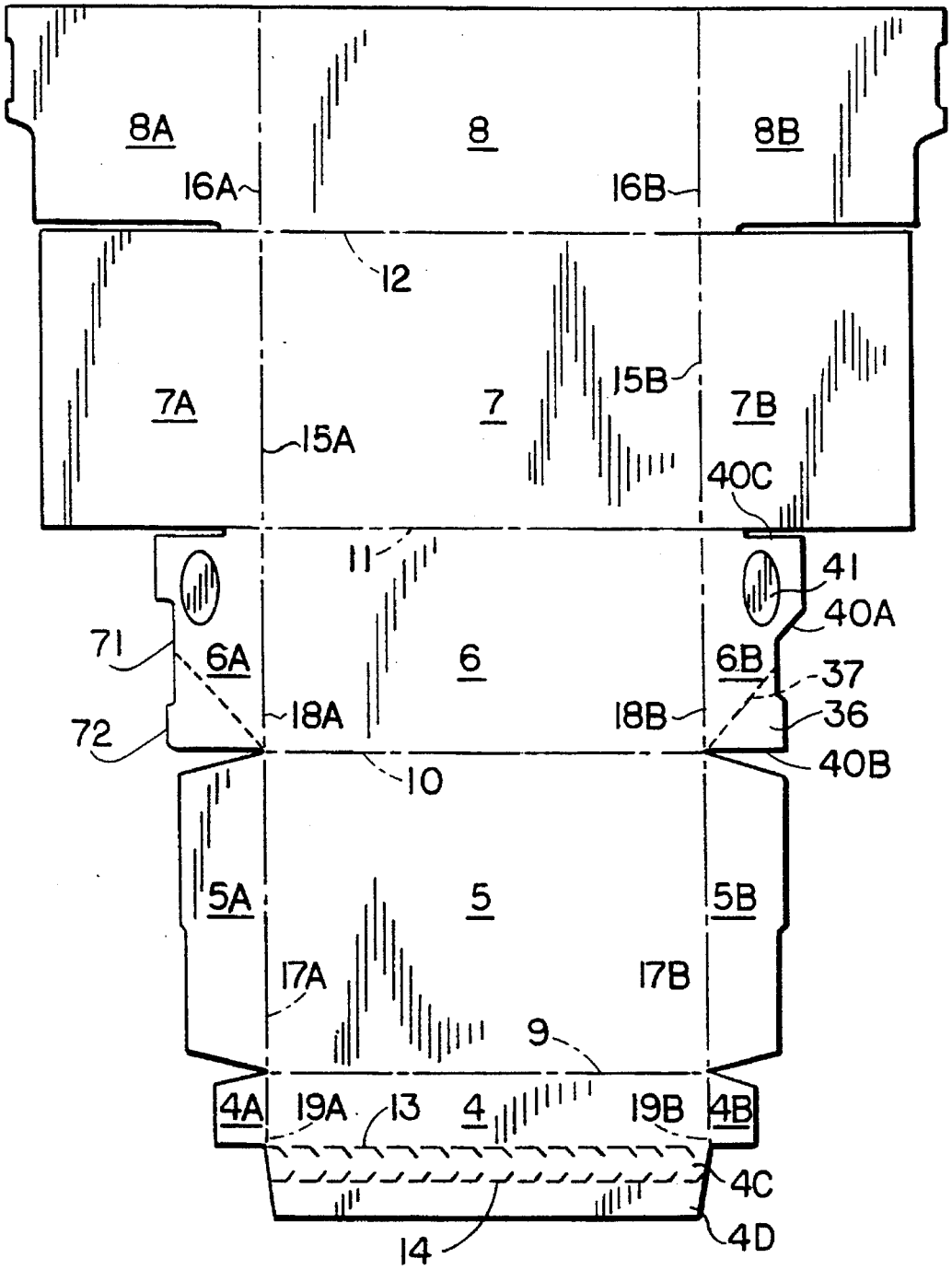
Figure 23:
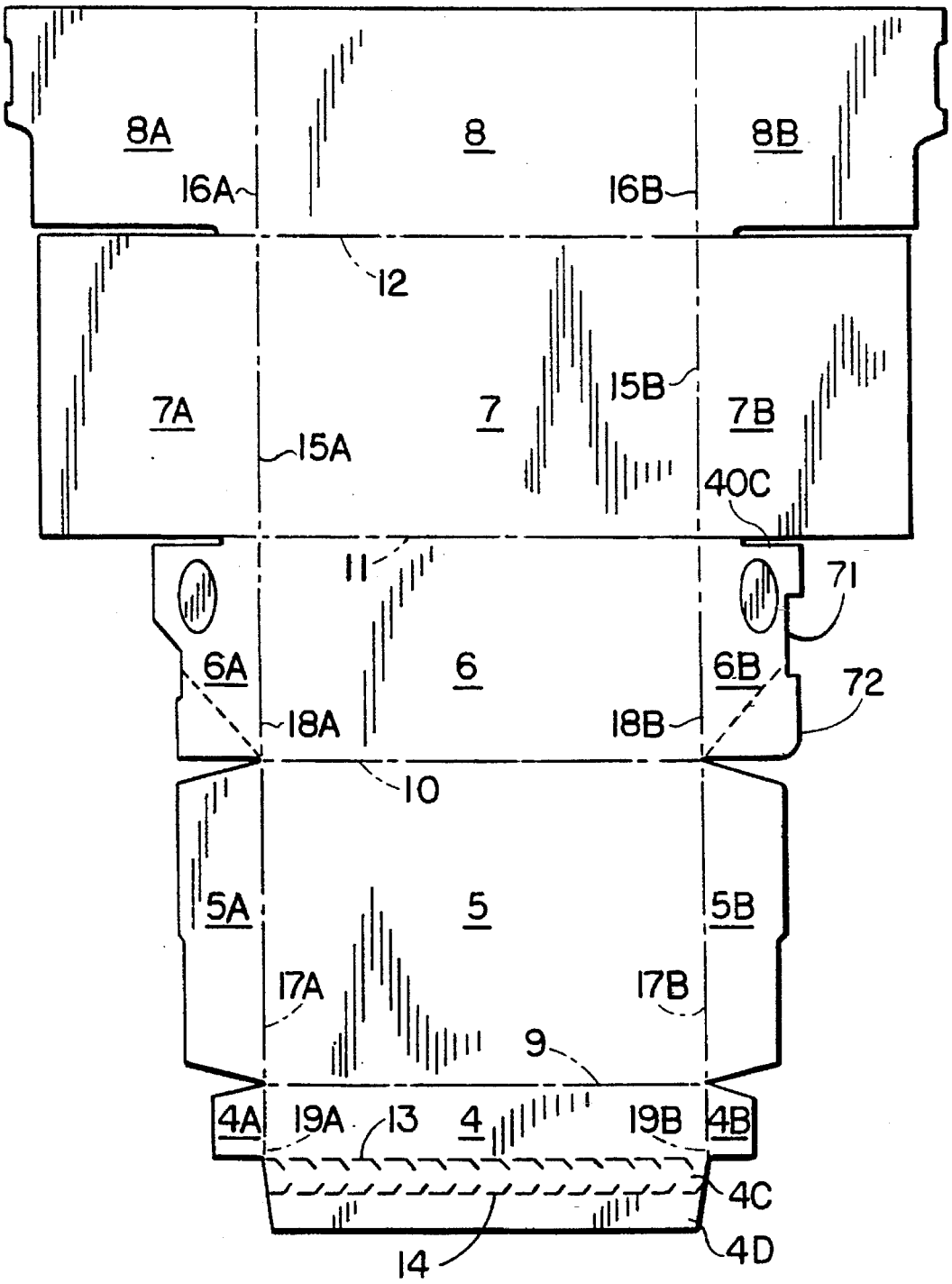
Figure 24:
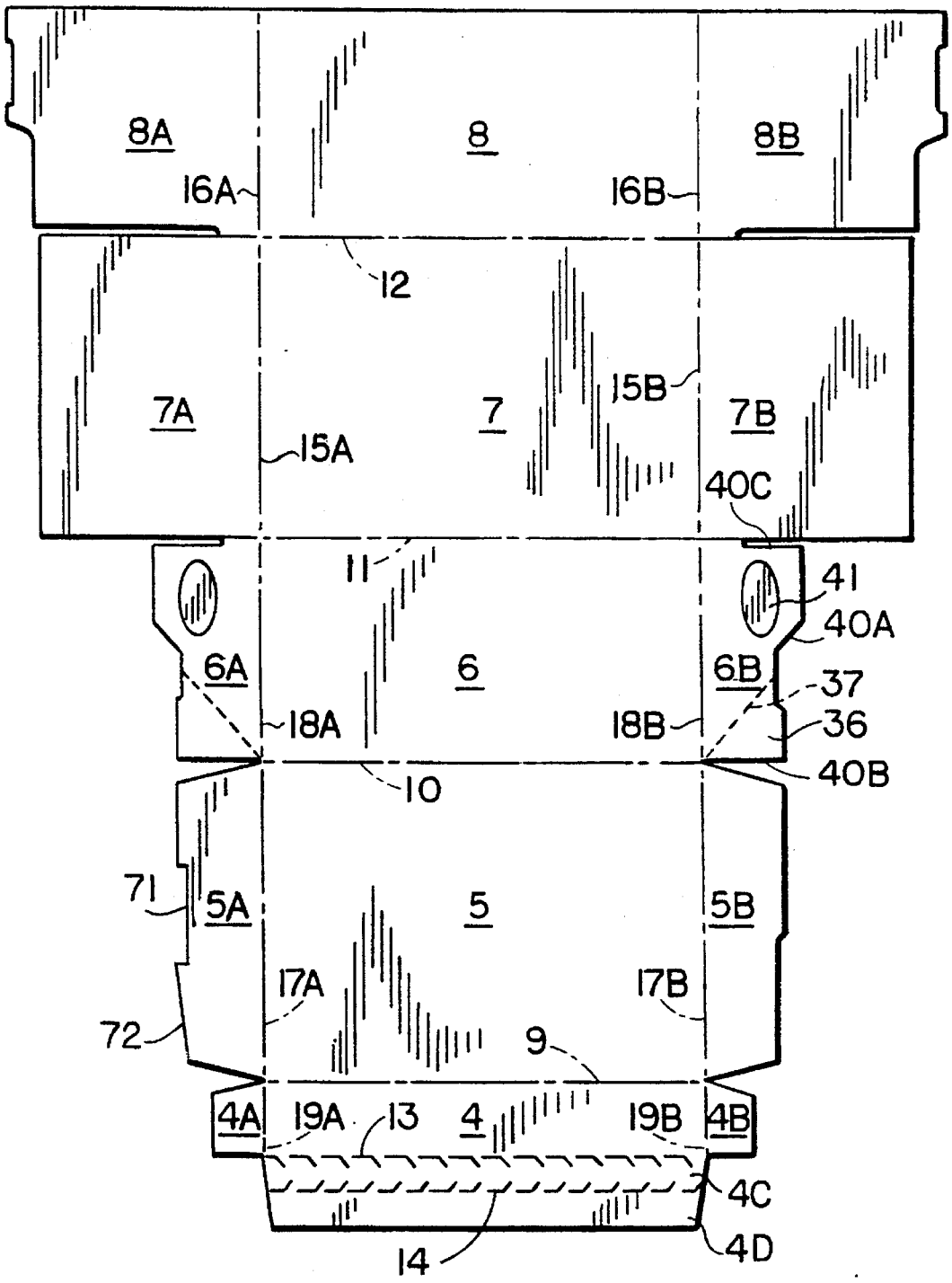
Figure 25:
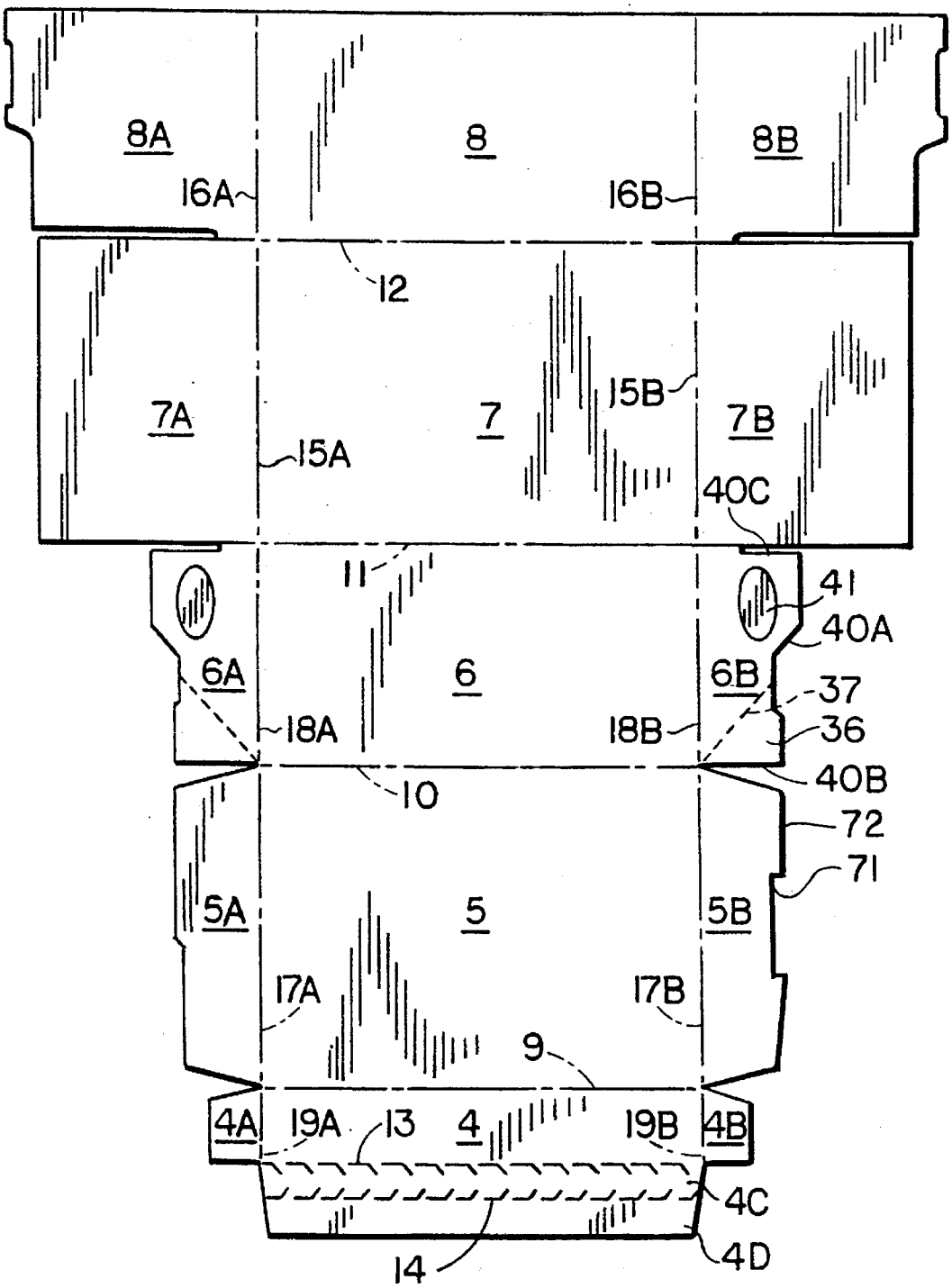

With reference to FIG. 1, right bottom panel end flap 7B is illustrated with feed gate engaging notch 71. Finishing machines such as adhesive applicators typically require a controlled entry point for receiving one carton blank at a time. FIG. 18 illustrates a portion of an adhesive applicator, generally designated 50, having an adjustable feed gate 51 which has opening 54 defined between feed contact 52 and belt 53. Opening 54 is used as a controlled entry point for transporting cut, printed blanks, one at a time, into applicator 50.

Feed gate 51 may be a rectangular piece of metal adapted with an angular, metal feed contact 52 at the lower end. The tolerance between feed contact 52 and the upper surface of belt 53 (defining opening 54) is selected to approximate a single thickness of paperboard (approximately 1/24,000 of an inch). Cut, printed blanks 55 are stacked and placed on motor-driven conveyor belt 53 which delivers the blanks one at a time into finishing machine 50, starting with the lowest blank in the stack, designated 56. A motorized feed chain (not shown) inside feed gate 51 displaces protrusion 57 and applies downward pressure on remaining stack 55.

As it enters finishing machine 50, blank 56 accelerates from zero lateral velocity to the speed of driving belt 53. Stack 55 provides a downward load which creates a drag on blank 56 as it passes under feed contact 52. Without feed gate engaging notch 71, this drag would smear the bleed line ink on blank 56. Engaging notch 71 allows blank 56 to interface with feed gate 51 without contacting the bleed line.

As shown in the illustrative drawing (FIG. 1), feed gate engaging notch 71 is centered along the edge of bottom panel end flap 7B. But, this is not a requirement or limitation for the present invention. Engaging notch 71 can be formed anywhere on the edge of bottom panel end flap 7B to adjust for different gate configurations and/or dimensions. Regardless of position, seal engaging edges 72 must extend for an appropriate length on either side of engaging notch 71.

It will also be appreciated that engaging notch 71 and seal engaging edges 72 can be placed on any main panel end flap to provide seven (7) additional embodiments depending on finishing equipment or process requirements.

As illustrated by FIG. 1, rear panel end flap 6B is defined by front edge 40A, top edge 40B, bottom edge 40C and score line 18B. Offset portion 41 is formed within a lower area of rear panel end flap 6B adjacent to front edge 40A, bottom edge 40C and score line 18B. Portion 41 is offset or projected from the plane of carton blank A in the same direction as score lines 912 and perforations 13 and 14. The projected dimension is approximately equal to a single thickness of paperboard stock.

Breakaway portion 36 is formed in an upper portion of rear panel end flaps 6A and 6B by breakaway perforations or lines of weakness 37 die-cut in the paperboard stock. Like score lines 9–12, die-cuts 13–14 and offset portion 41, breakaway perforation 37 is die-cut in the same downward direction with reference to the upper surface of blank A.

According to the present invention, breakaway portion 36 of blank A is adapted for adhesive attachment to an underlying portion of top panel end flaps 5A and 5B in an assembled carton. Adhesive attachment is preferably achieved by extending single lines of adhesive which are typically used to secure the end wall-forming flaps at both ends of an erected carton.

Figure 2A:
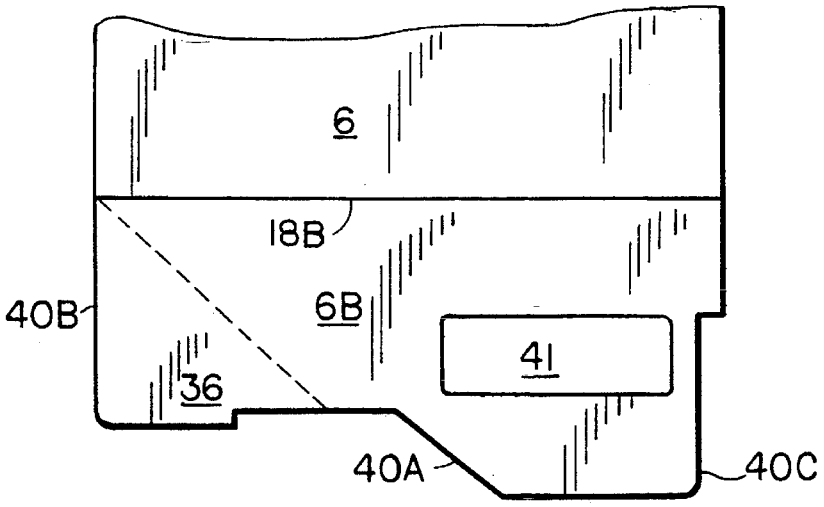
FIG. 2A is a fragmentary plan view of the rear panel and hingedly connected rear panel end flap. It illustrates the placement of the offset portion on the rear panel end flap.
Figure 2B:
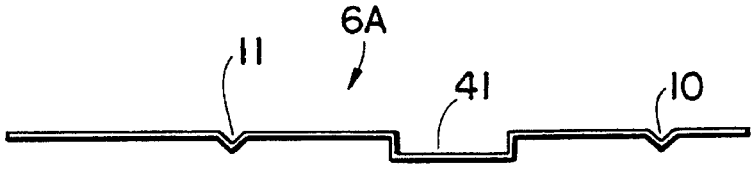
FIG. 2B is an enlarged end view of the rear panel end flap shown in FIG. 2A. It illustrates the rear panel end flap offset portion and score lines disposed in the same direction with reference to the carton blank.
Figure 2C:
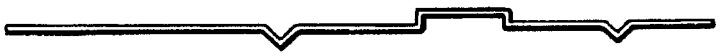
FIG.2C PRIOR ART
FIG. 2C is an enlarged end view of the prior art rear panel end flap. It illustrates the rear panel end flap offset portion and score lines disposed in opposite directions with reference to the carton blank.

FIG. 2A is a plan view of rear panel end flap 6B showing the placement of breakaway portion 36 and offset portion 41. FIG. 2B illustrates an end view of rear panel end flap 6B with offset portion 41 and score lines 10 and 11. According to the present invention, all die-cuttings and die-stampings are projected in the same downward direction from the upper surface of carton blank A. This unitary configuration differs from the prior art technique illustrated by FIG. 2C.

Figure 3:
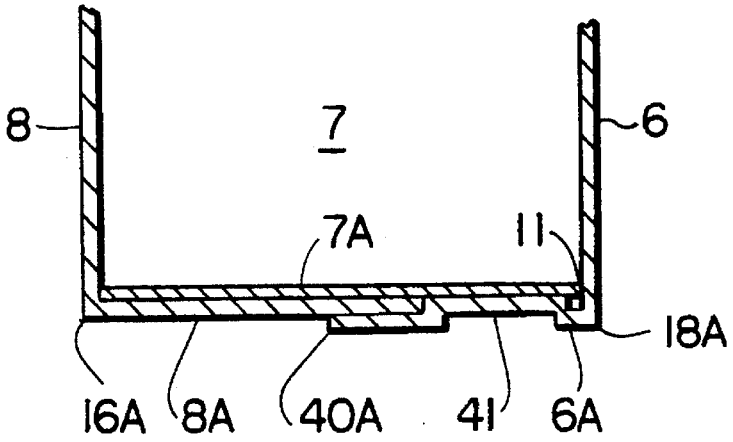
FIG. 3 is a fragmentary top view of the FIG. 1 carton blank in the folded condition. It illustrates the bottom panel end flap, front panel end flap and offset portion of the rear panel end flap disposed substantially in the same plane for adhesive attachment.

As shown in greater detail by FIG. 3, carton blank A is partially assembled by arranging bottom panel end flap 7A, front panel end flap 8A, top panel end flap 5A (not shown) and rear panel end flap 6A according to the art-recognized flap folding sequence. Bottom panel end flap 7A is first folded along score line 15A; front panel end flap 8A is next folded along score line 16A and rear panel end flap 6A is last folded along score line 18A to contact bottom panel end flap 7A and front panel end flap 8A.

As shown by the fragmentary top view of FIG. 3, offset portion 41 is projected inwardly toward bottom panel end flap 7A for a distance approximately equal to a single thickness of paperboard stock. Front edge 40A of rear panel end flap 6A cooperates with front panel end flap 8A and offset portion 41 cooperates with bottom panel end flap 7A.

In this folded configuration, rear panel end flap 6A simultaneously contacts front panel end flap 8A and bottom panel end flap 7A to provide improved adhesive attachment for the end wall forming flaps.

Additional features of the present invention will now be described. Using blank A, a carton is assembled by first forming an intermediate carton sleeve. Front panel 8 of blank A is folded along score line 12 to overlie a portion of bottom panel 7. Glue is then applied to the interior side of cover panel 4 or the exterior side of front panel 8. Top panel 5 is folded about score line 10 over rear panel 6 and bottom panel 7. In this configuration, cover portion 4D is adhesively secured to the exterior surface of front panel 8 to form a carton sleeve.

A carton is next formed from this partially assembled sleeve. First, a carton sleeve is squared-up to form open-ended carton 32 having bottom end 34 and top end 33, as shown in FIG. 4A. First and second top panel end flaps 5A and 5B are substantially co-planar with top panel 5; rear panel end flaps 6A and 6B are substantially co-planar with rear panel 6; bottom panel end flaps 7A and 7B are substantially co-planar with bottom panel 7; and front panel end flaps 8A and 8B are substantially co-planar with front panel 8. In this configuration, cover panel end flaps 4A and 4B are substantially co-planar with cover panel 4 (not shown). To assemble carton 32, bottom end 34 is closed first according to the description provided in connection with FIG. 4A.

In general terms, bottom end 34 of partially assembled carton 32 is closed by folding bottom panel end flap 7A first; front panel end flap 8A second; cover panel end flap 5A third; and rear panel end flap 6A fourth. An identical flap-folding sequence is subsequently performed to close top end 33 of carton 32.

Bottom panel end flap 7A is first folded substantially perpendicular to bottom panel 7. In this position, bottom panel end flap 7A essentially closes bottom end 34 of partially assembled carton 32. Front panel end flap 8A is next folded inwardly and substantially perpendicular to front panel 8 to overlap a portion of bottom panel end flap 7A. Top panel end flap 5A is then folded down to overlie a portion of front panel end flap 8A and a coincident portion of bottom panel end flap 7A.

At this point in the flap-folding sequence, a single line of adhesive 38 is deposited on the lower and rearward portion of bottom panel end flap 7A using a conventional applicator nozzle. With offset portion 41 positioned on rear panel end flap 6A, single glue line 38 is deposited on the flat surface of bottom panel end flap 7A. This flat surface provides for regular operating conditions and uniform glue deposits which improve adhesion between the end wall-forming flaps.

Figure 4B:
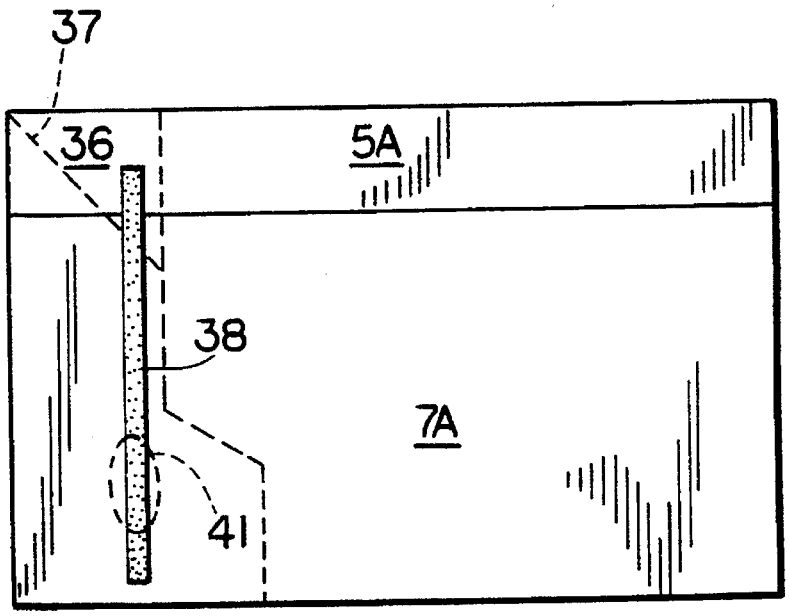
FIG. 4B is a side view of a partially assembled carton. It illustrates the placement of a single glue line used to adhere the end wall-forming flaps.
Figure 4A:
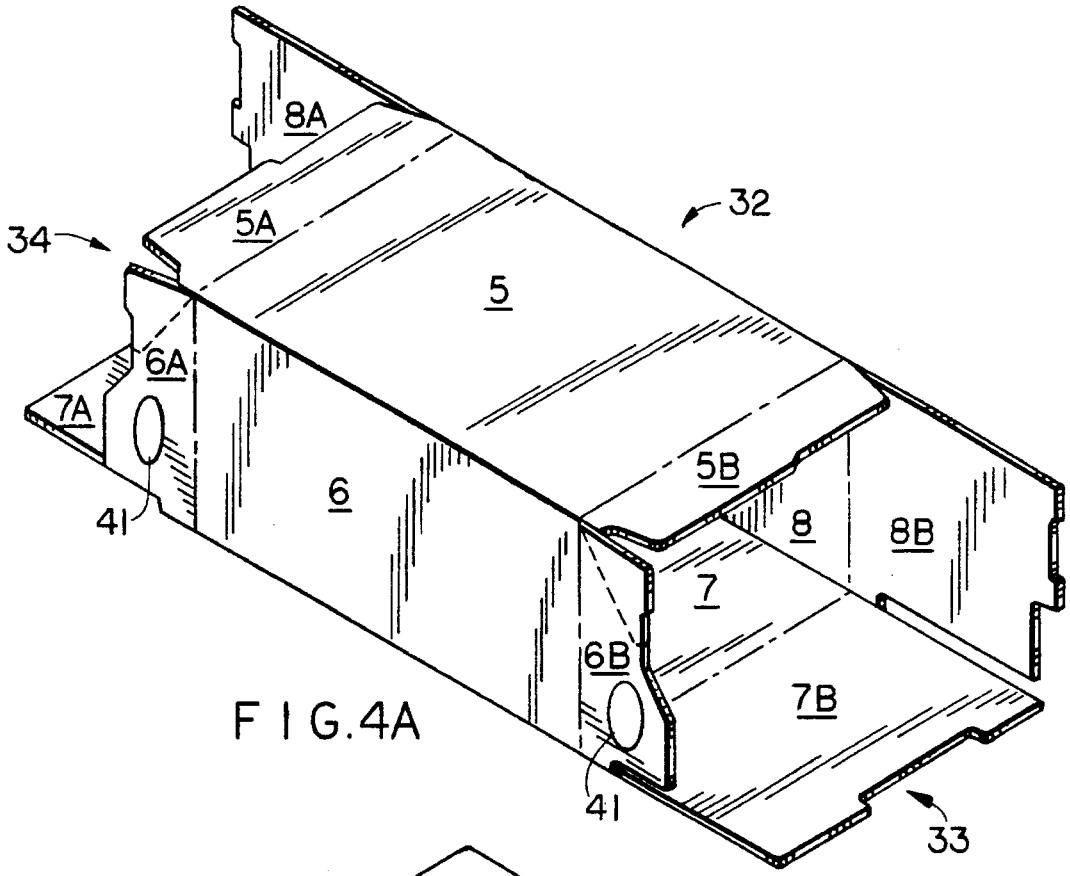
FIG. 4A is a perspective view of a carton tube (i.e., sleeve) assembled from a blank illustrated in FIG. 1.

As shown in FIG. 4B, single glue line 38 is extended onto the exterior surface of top panel end flap 5A so that breakaway feature 36 will be secured to underlying portion of top panel end flap 5A in a fully assembled carton.

To complete the flap-folding sequence, rear panel end flap A with offset portion 41 is folded fourth and last to adhesively secure the end wall-forming flaps of blank A. Rear panel end flap 6A directly contacts bottom panel end flap 7A about a major area of offset portion 41. This co-planar arrangement improves adhesion between the end flaps and provides increased stability for a subsequently assembled carton.

During a typical filling operation, preselected solid or semi-solid products such as candy, ice cream, snack chips, novelty items and the like are delivered to the receptacle formed by main panels 4–8 and the end wall-forming flaps which close bottom end 34 of partially assembled carton 32. An identical flap-folding sequence is subsequently performed on top end 33 of partially assembled carton 32. In specific terms, bottom panel end flap 7B is folded first, front panel end flap 8B is folded second, top panel end flap 5B is folded third and rear panel end flap 6B is folded fourth and last.

Figure 5:
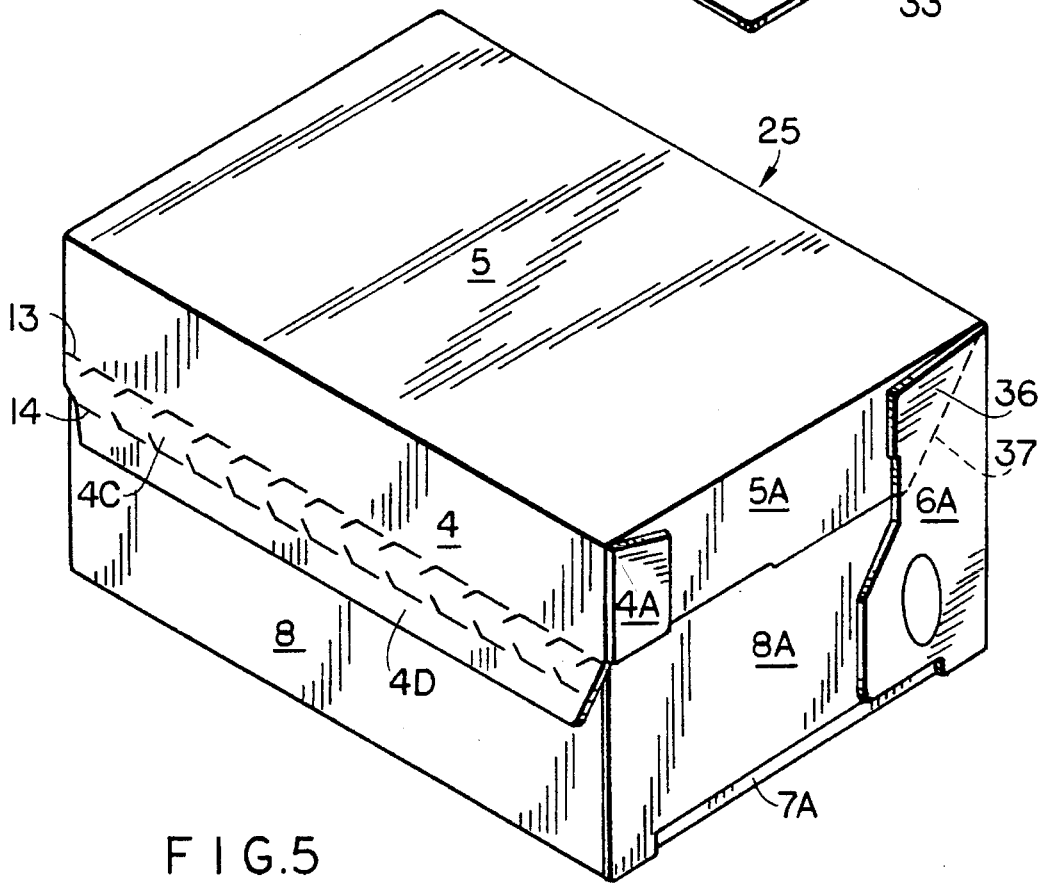
FIG. 5 is a perspective view of a carton assembled from a blank illustrated in FIG. 1.
Figure 6:
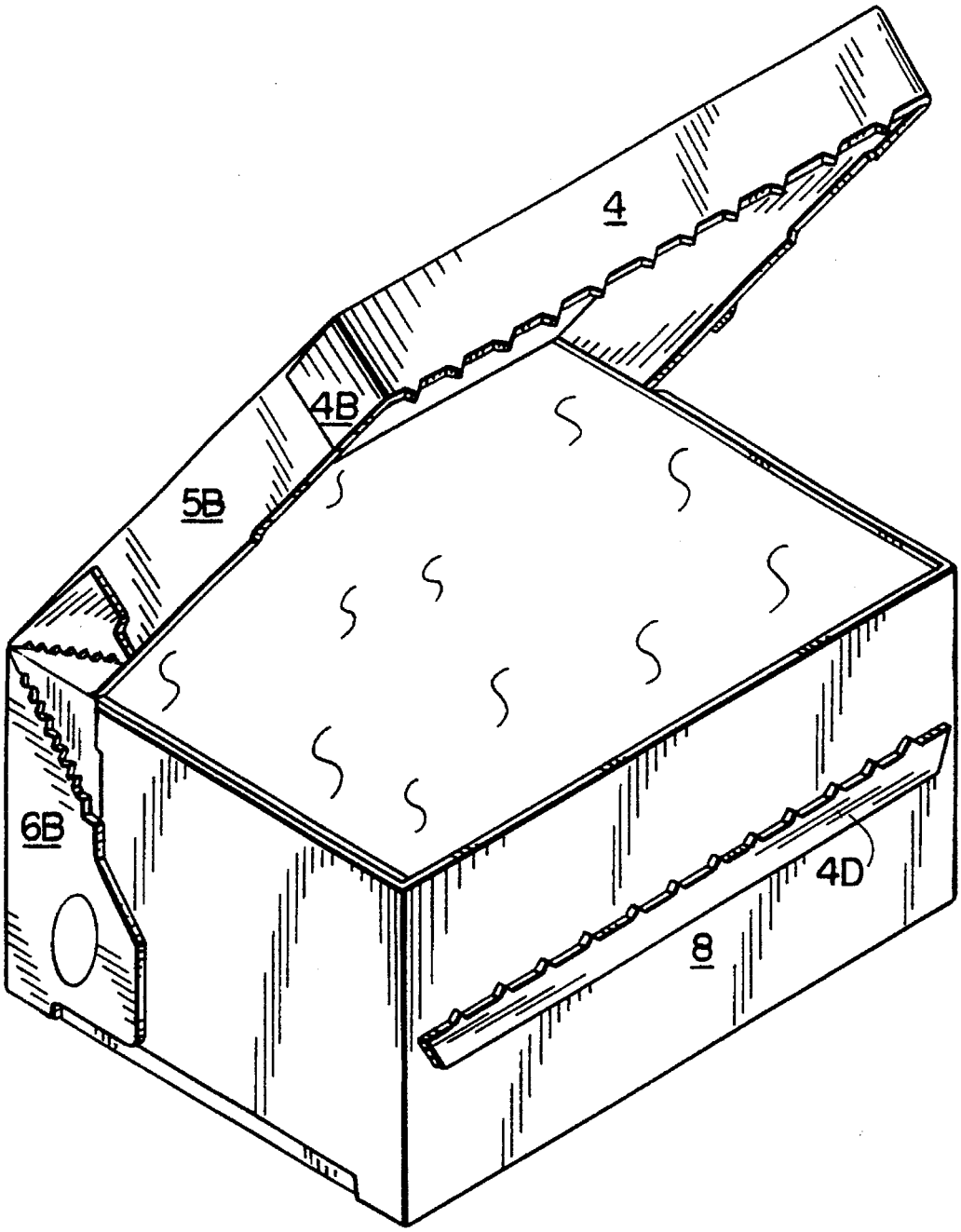
FIG. 6 is a perspective view of an opened carton with the tear strip removed.

The previously described adhesive deposition technique is also repeated to secure top end 33. This operation provides fully assembled carton 25 as shown in FIG. 5. During end-use application, tear strip 4C is removed in a conventional manner, cover panel 4 and top panel 5 are opened and breakaway tabs 36 are released as shown in FIG. 6.

In the preferred form of this invention, front panel 8 and front panel end flaps 8A and 8B of blank A are designed to minimize paperboard consumption without compromising the structural integrity of a corresponding carton. Blanks of the type described in this specification are typically manufactured from large paperboard sheets in a ten-up (two rows of five) configuration. Individual blanks are "nested" on plural sides to provide an efficient layout for the blanking operation.

Figure 7:
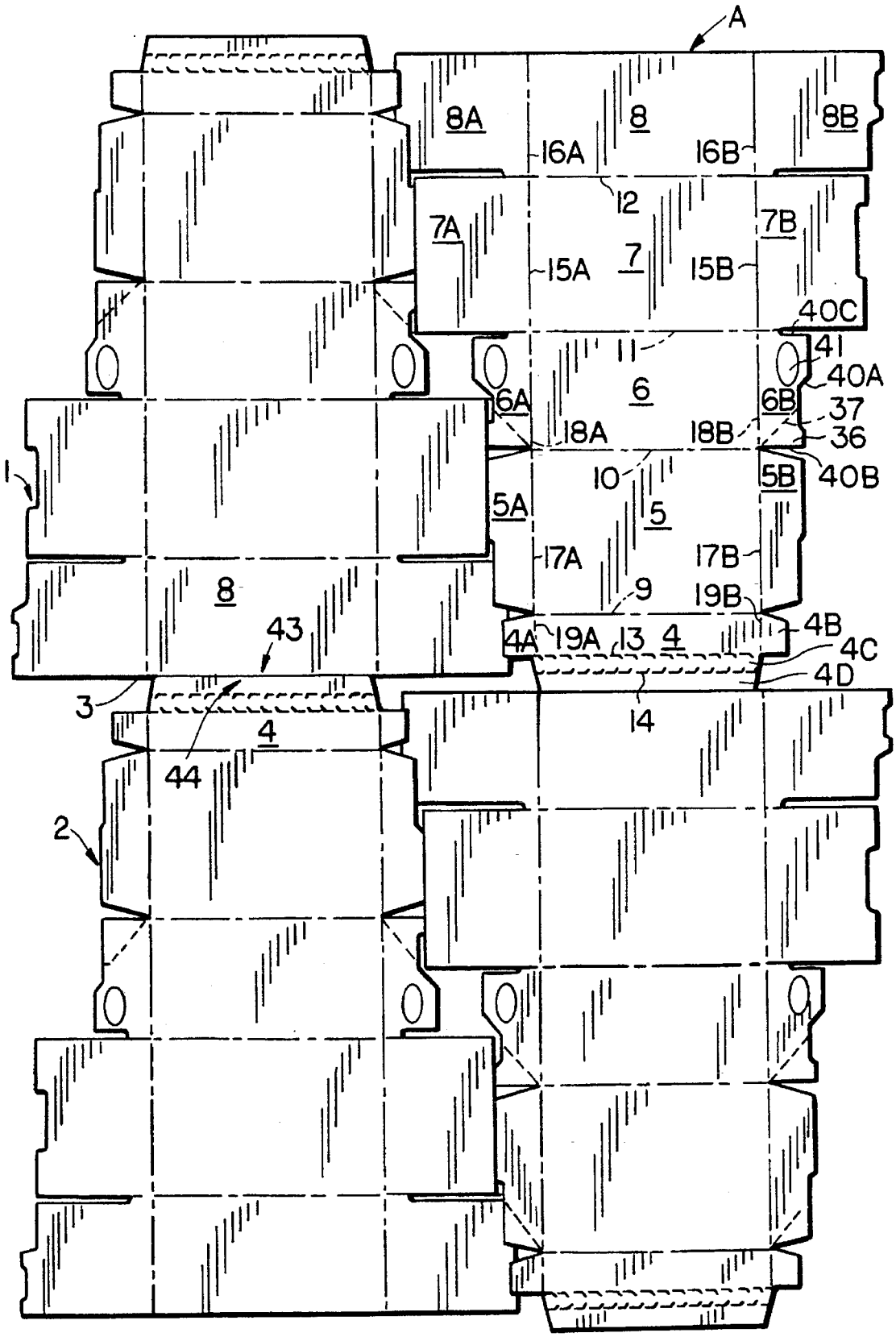
FIG. 7 is a fragmentary plan view of four carton blanks in the preferred form of this invention. It illustrates the orientation and nesting pattern for the blanking operation.

Referring to FIG. 7, representative blank 1 and adjacent blank 2 are nested along interface 3 in a manner previously unknown to the art. In this preferred configuration, outer edge 43 of front panel 8 (blank 1) and outer edge 44 of cover panel 4 (blank 2) are formed with a single knifing operation. In its preferred embodiment, blank A provides a "tighter" nesting configuration, significantly reduces raw material costs and contributes to manufacturing efficiency.

Figure 8:
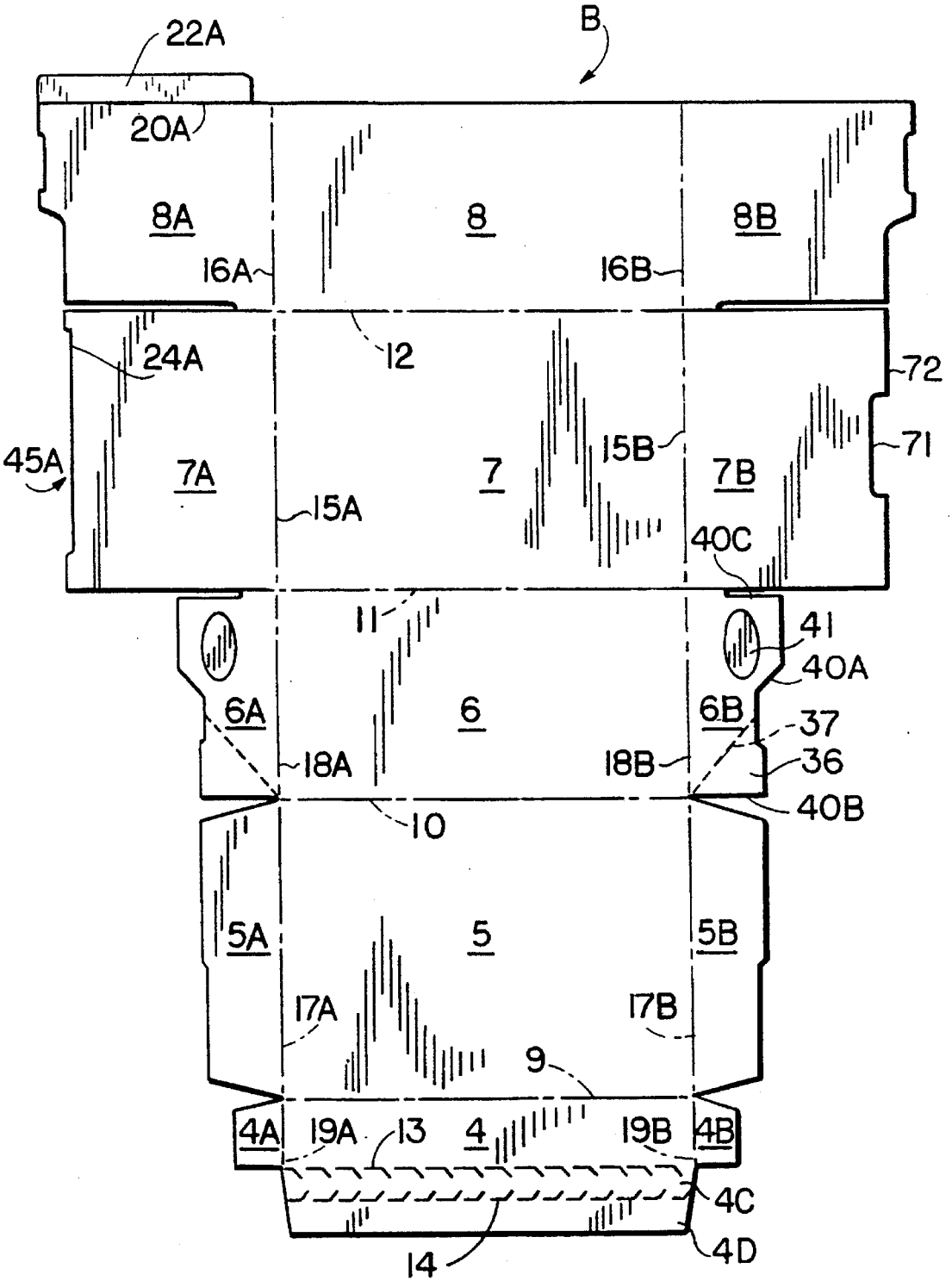
FIG. 8 is a plan view of a flat carton blank formed in accordance with a second embodiment of the present invention.

Blank B illustrated in FIG. 8 is substantially identical to blank A of FIG. 1. The principal difference is provided by membrane 22A which is hingedly connected to front panel end flap 8A along a minor or major length of fold line 20A at bottom end 34. In this second configuration, bottom panel end flap 7A has recess 24A formed in outer marginal edge 45A. Recess 24A is adapted to cooperate with membrane 22A in the folded condition.

Figure 9:
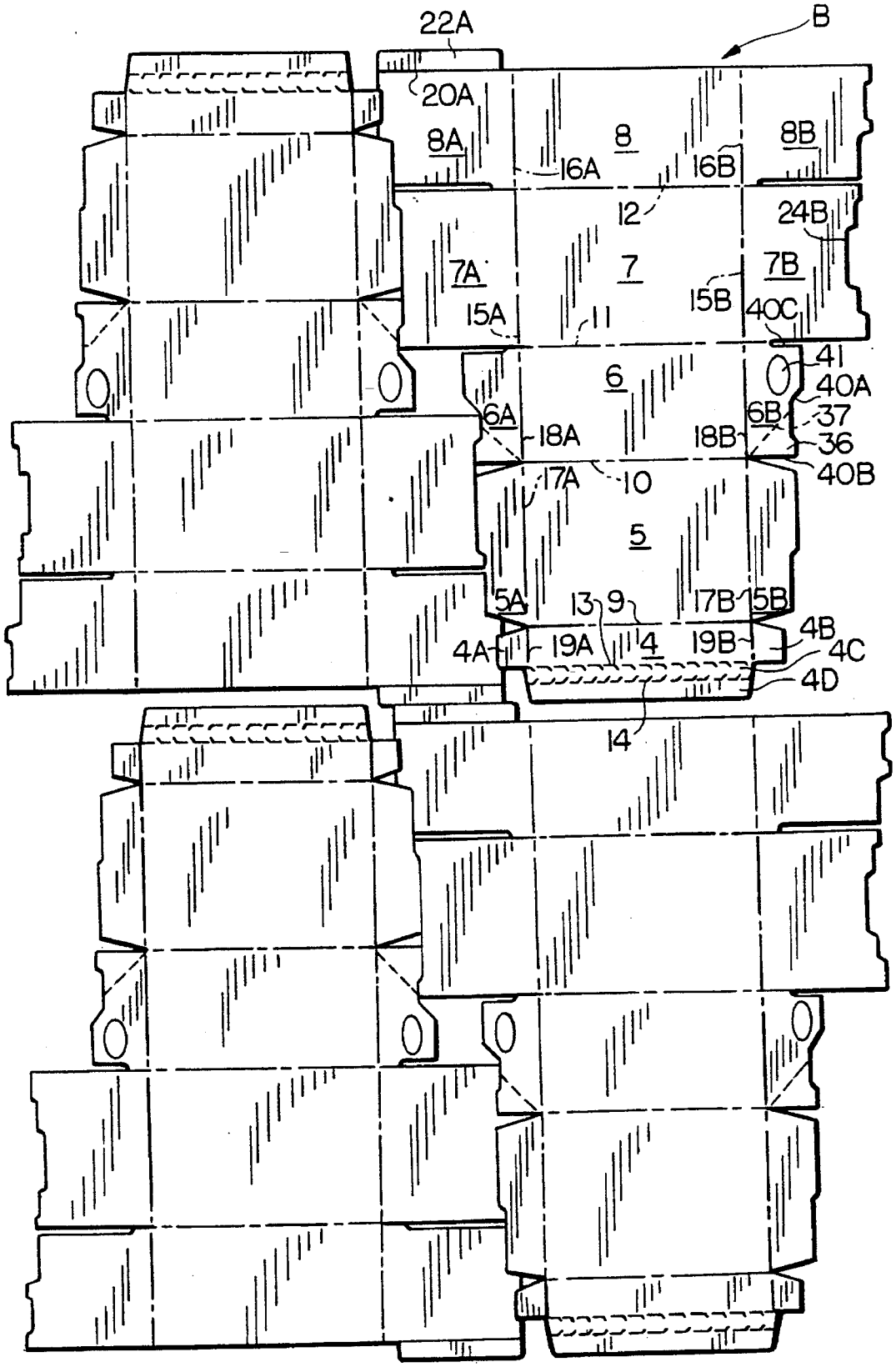
FIG. 9 is a fragmentary plan view of four carton blanks formed in accordance with a second embodiment of the present invention.
Figure 10:
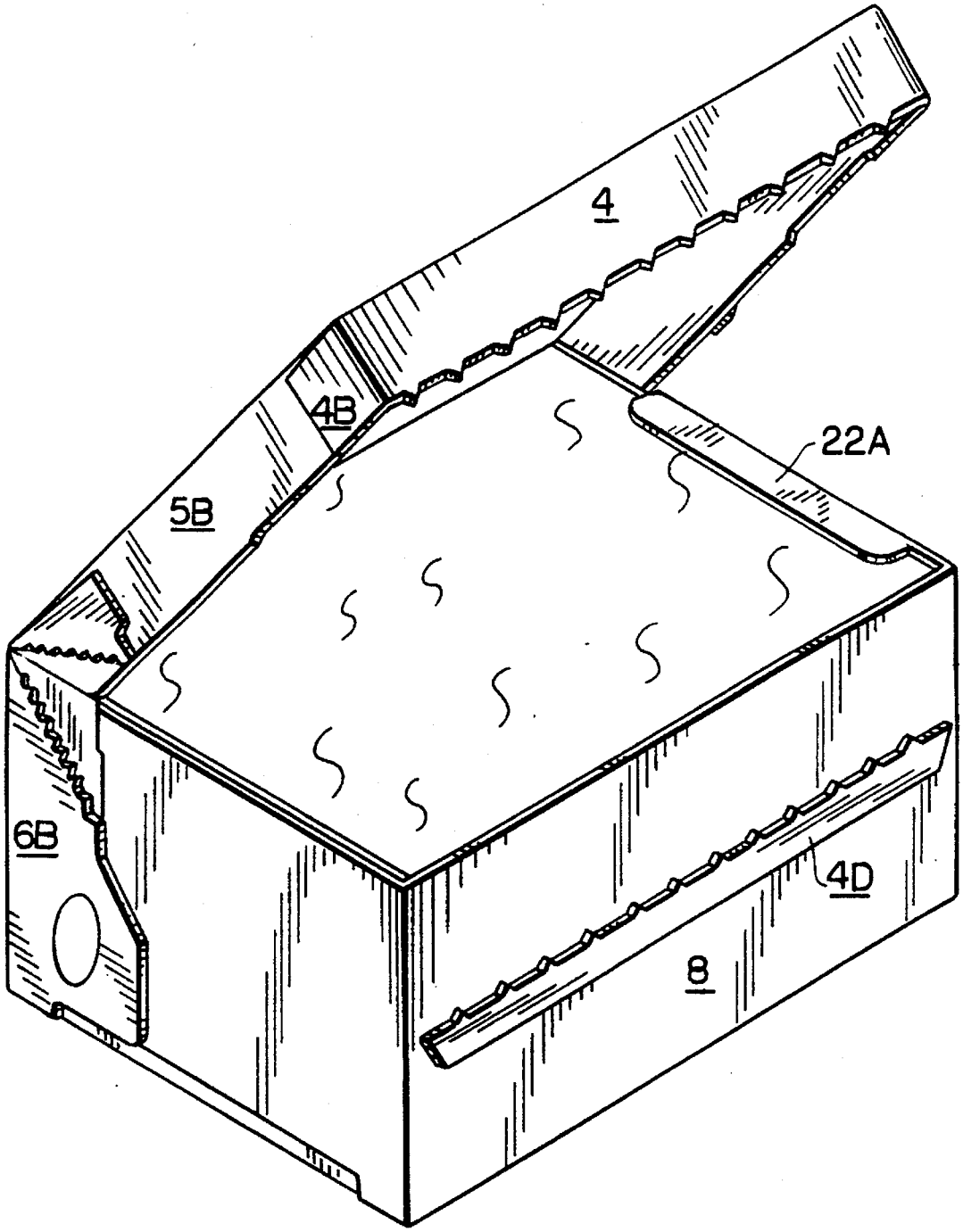
FIG. 10 is a perspective view of a carton assembled from a blank illustrated in FIG. 8.

As illustrated by FIG. 9, the nesting configuration for blank B is similar to the nesting configuration for blank A as shown in FIG. 7. Additional paperboard is required for the blank B configuration depending on the width dimension of membrane 22A. It will be appreciated that blank B is useful for those applications which require some degree of structural integrity and leakproof performance for cartons used to package semi-solid goods. A corresponding carton in the open condition is shown in FIG. 10.

Figure 11:
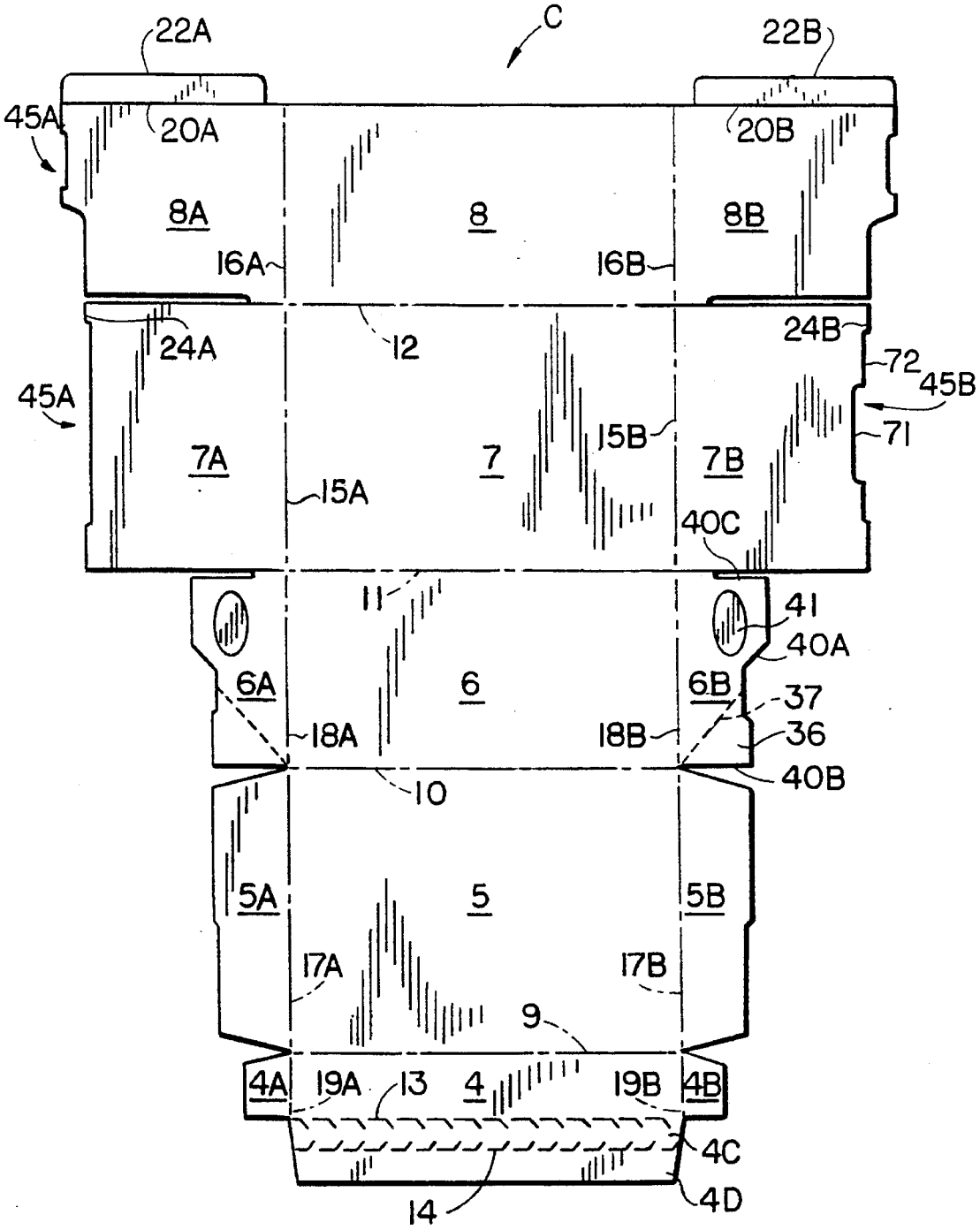
FIG. 11 is a plan view of a flat carton blank formed in accordance with a third embodiment of the present invention.

Blank C illustrated in FIG. 11 is substantially identical to blank B of FIG. 9. The principal difference is provided by second membrane 22B which is hingedly connected to front panel end flap 8B along a minor or major length of fold line 20B at top end 33. In this third configuration, bottom panel end flap 7B has second recess 24B formed in outer marginal edge 45B. Recess 24B is adapted to cooperate with membrane 22B in the folded condition.

Figure 12:
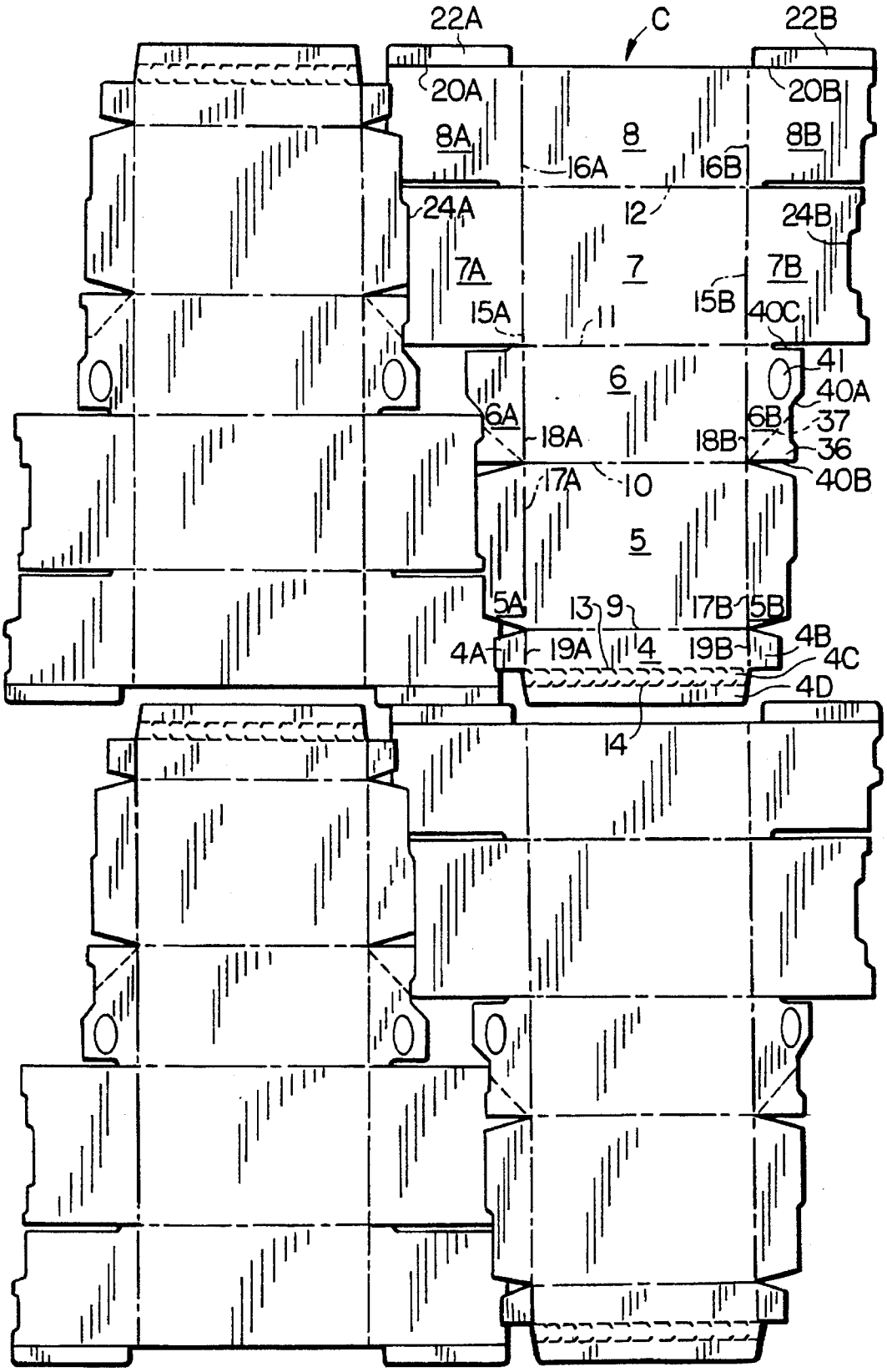
FIG. 12 is a fragmentary plan view of four carton blanks formed in accordance with a third embodiment of the present invention.

As illustrated by FIG. 12, the nesting configuration for blank C is similar to that of blank A of FIG. 7 and blank B of FIG. 9. Additional paperboard is necessarily required for the placement of membrane 22B on front panel end flap 8B. Blank C is useful for those applications which require an extra degree of structural integrity and leakproof performance for an assembled carton as shown in FIG. 13.

Figure 13:
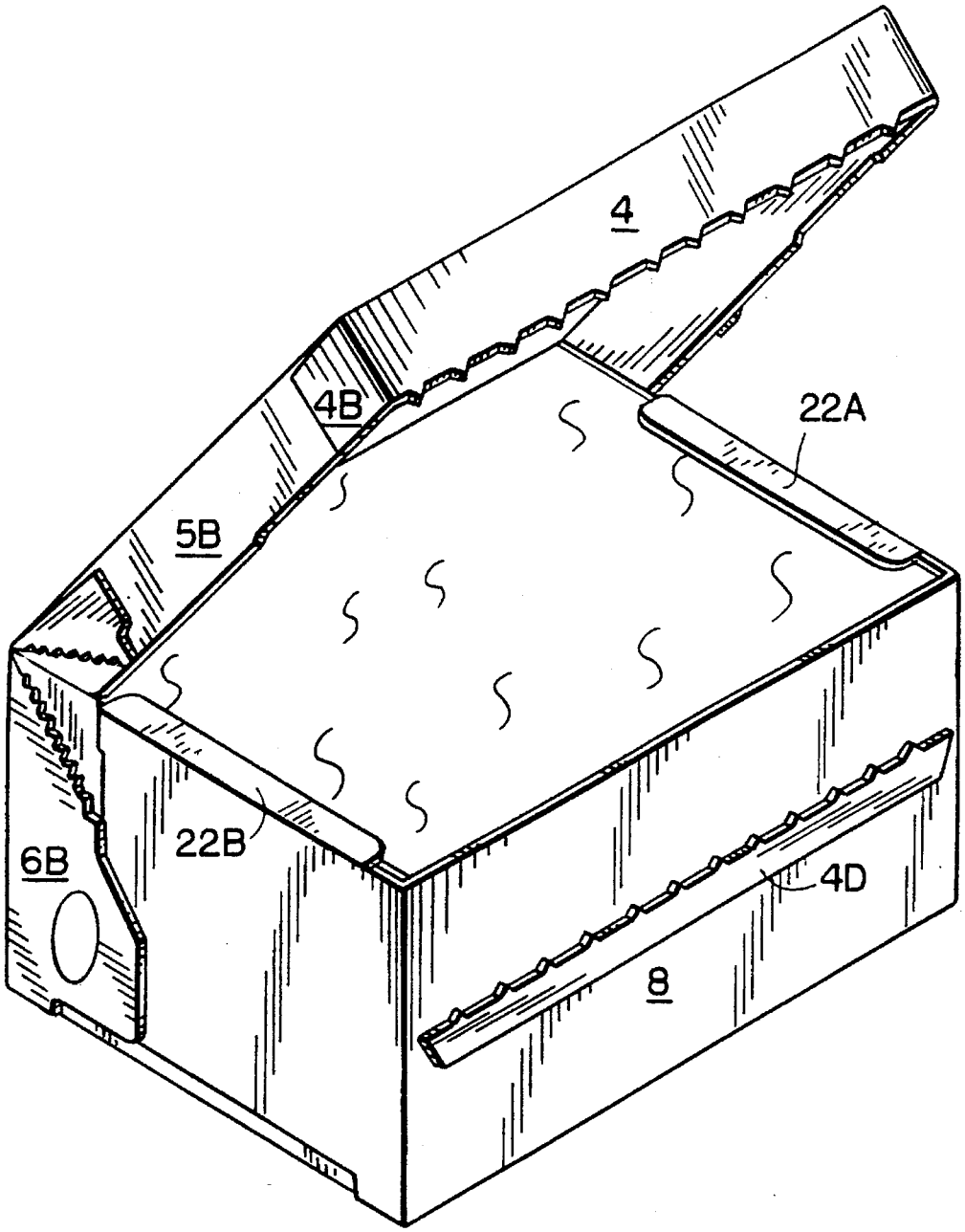
FIG. 13 is a perspective view of a carton assembled from a blank illustrated in FIG. 11.
Figure 15:
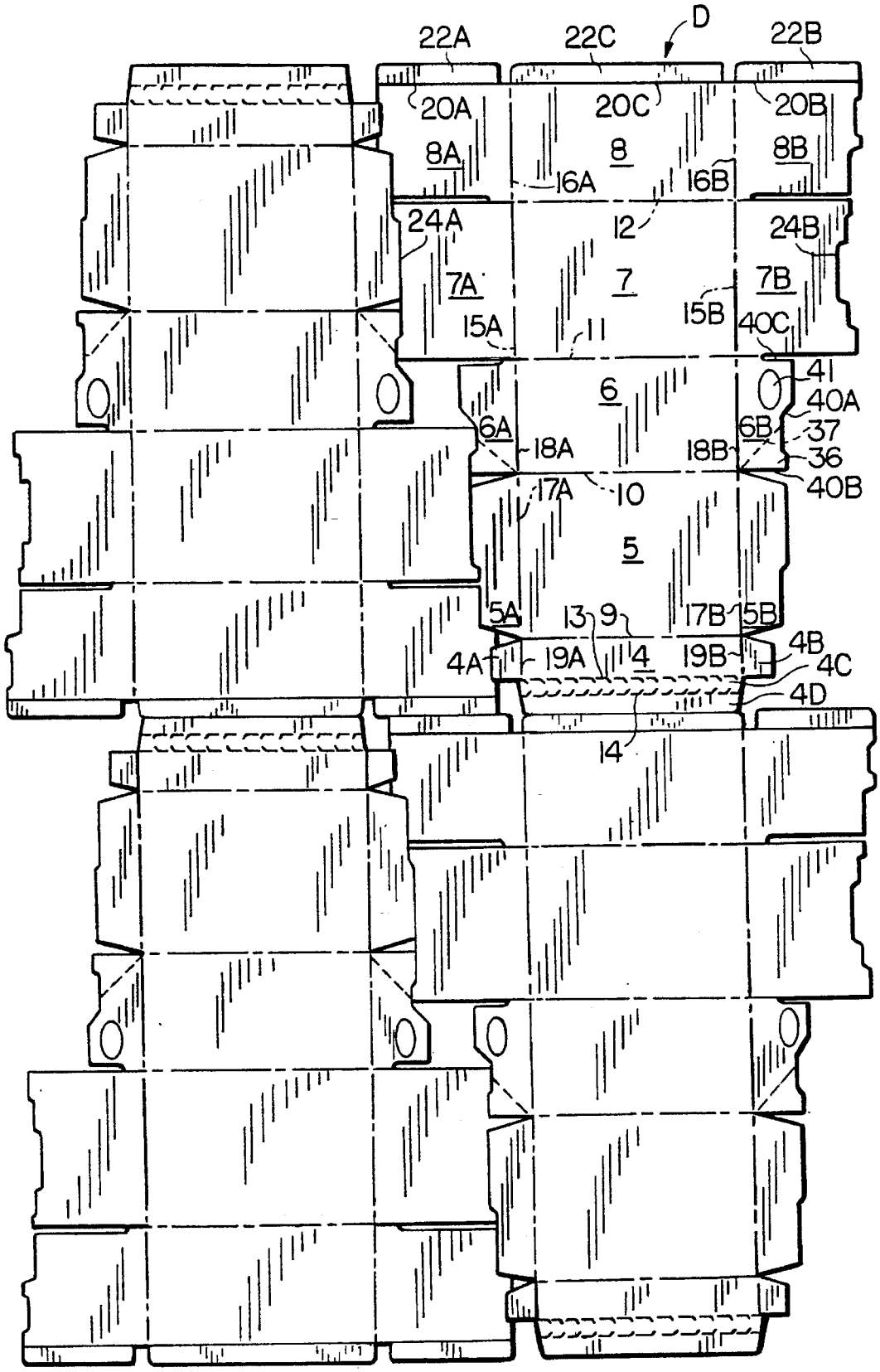
FIG. 15 is a fragmentary plan view of four carton blanks formed in accordance with a fourth embodiment of the present invention.
Figure 16:
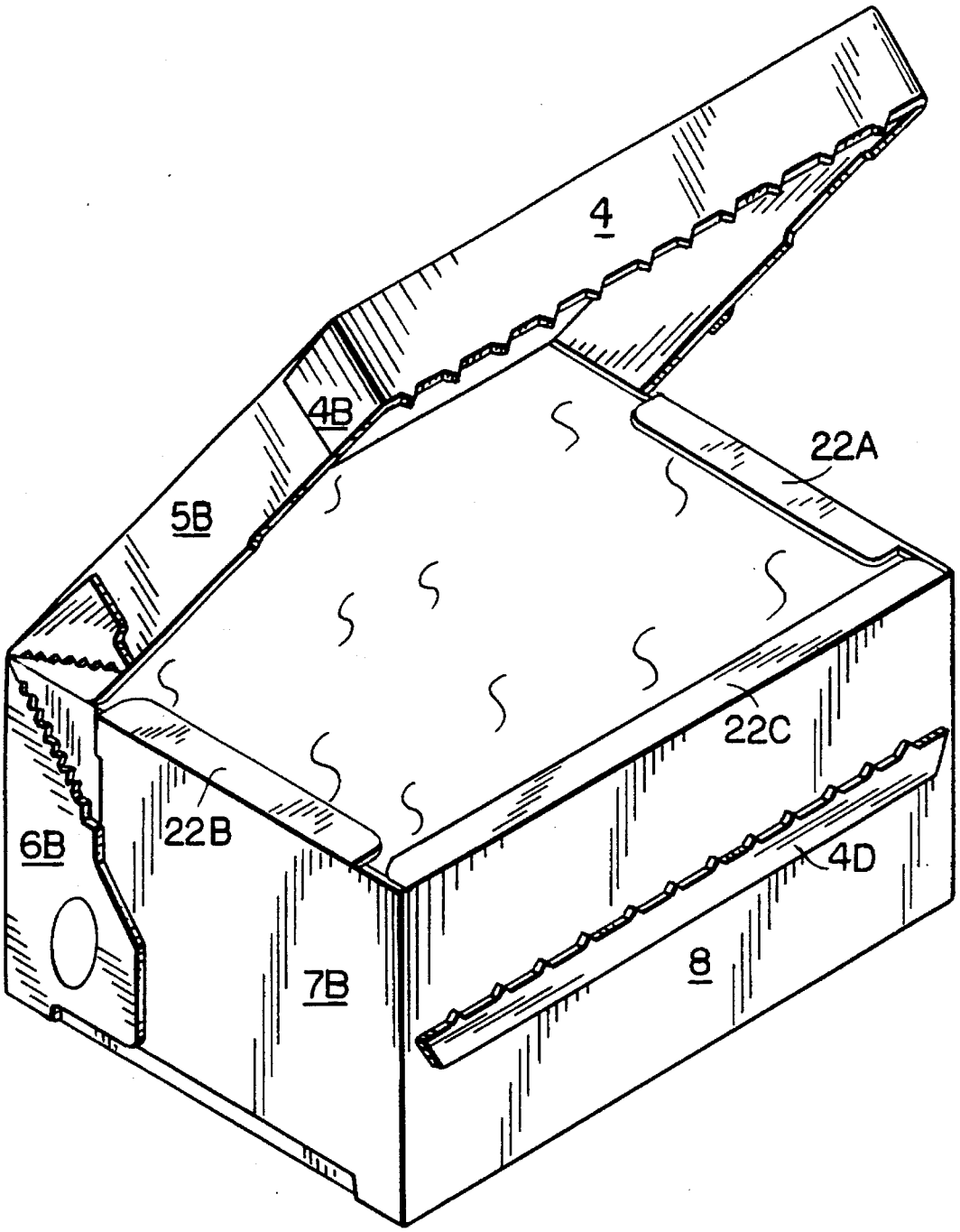
FIG. 16 is a perspective view of a carton assembled from a blank illustrated in FIG. 14.

Blank D illustrated in FIG. 13 is substantially identical to blank C of FIG. 11. The only difference is provided by membrane 22C which is hingedly connected to front panel 8 along a minor or major length of fold line 20C. As illustrated by FIG. 15, the nesting configuration for blank D is similar to that of blanks A, B and C as illustrated by FIGS. 7, 9 and 12. It will be appreciated that blank D maximizes the use of paperboard stock but optimizes structural integrity and leakproof characteristics. A corresponding carton in the open condition is shown in FIG. 16.

Figure 14:
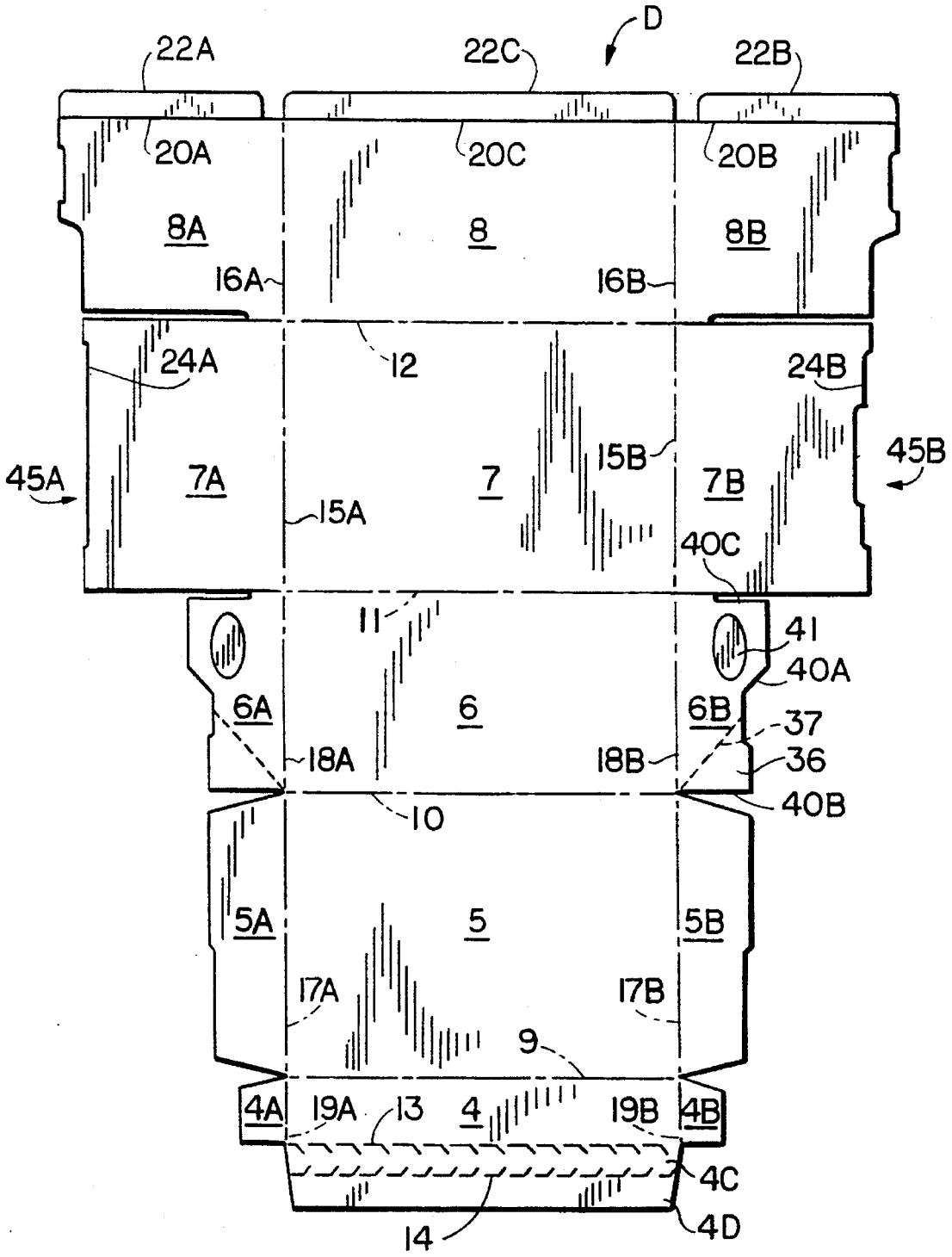
FIG. 14 is a plan view of a flat carton blank formed in accordance with a fourth embodiment of the present invention.
Figure 17:
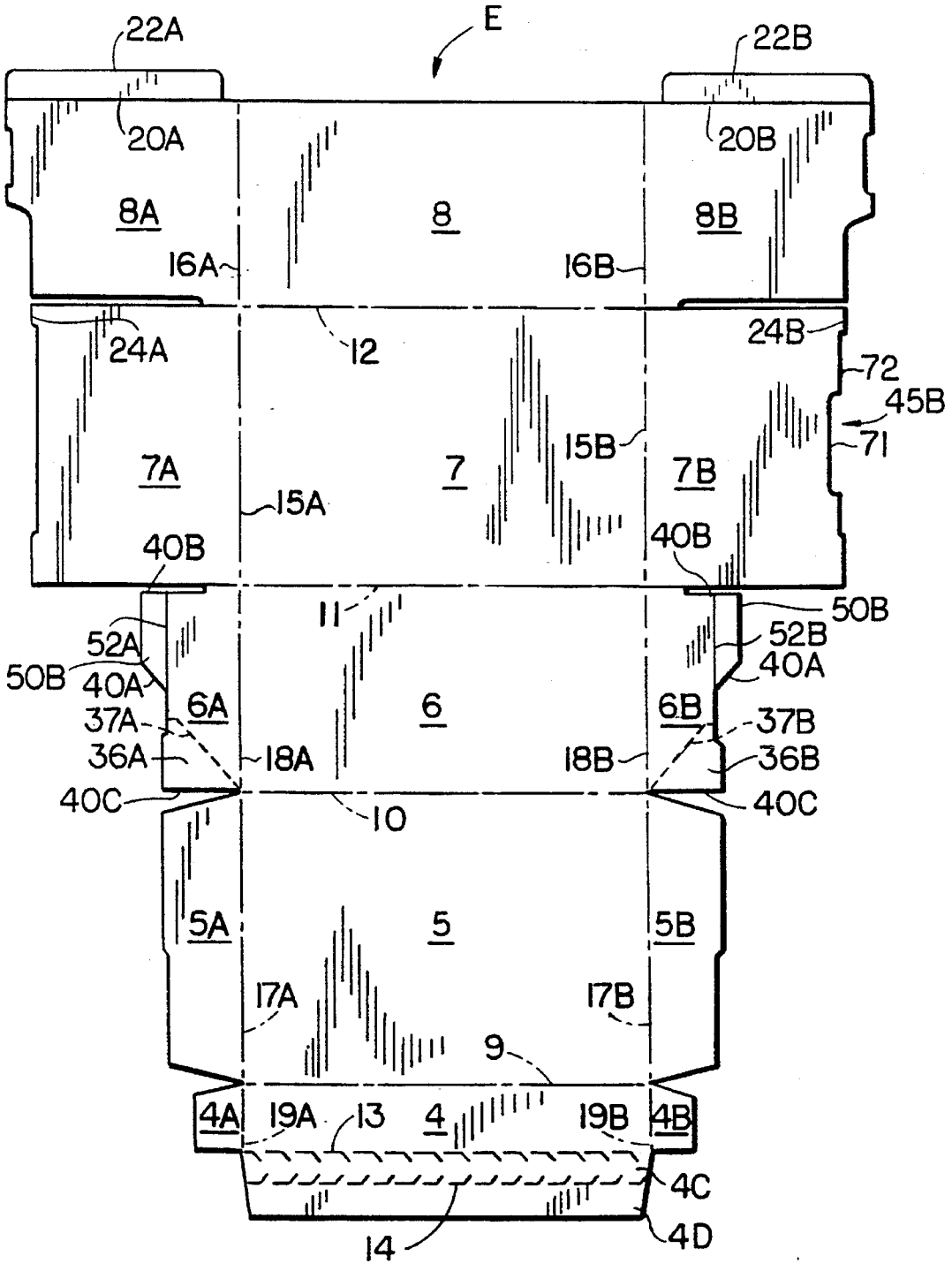
FIG. 17 is a plan view of a carton blank illustrating a further embodiment of the present invention.

In the embodiment illustrated by FIG. 17, carton blank E is similar to carton blank D as shown in FIG. 14. Corresponding reference numerals identify similar features of these two embodiments. One difference is that blank E of FIG. 17 includes only two lip membranes 22A and 22B extending from the upper edges of front panel end flaps 8A and 8B. But, as previously disclosed, the carton blank can be constructed with no lip membranes as shown in FIG. 1; one lip membrane as shown in FIG. 8 or three lip membranes in the embodiment of FIG. 14.

FIG. 17 illustrates that rear panel end flaps 6A and 6B do not include offset portion 41. Instead, end flaps 6A and 6B include tabs 50A and 50B defined by score lines or flex joints 52A and 52B, respectively. Like other die stampings in carton blank E, score lines 52A and 52B are formed in a single, downward direction with reference to the plane of the blank.

The arrangement of tabs 50A and 50B allows for flexing of the paperboard and permits intimate contact between the remaining portions of end flaps 6A and 6B and the glue line deposited during carton assembly. A secure bond is achieved, thereby avoiding gaps in the end walls and reducing the possibility of semi-solid leakage. This embodiment contributes to a smoother, more attractive appearance for the carton.

Various modifications and alterations to the present invention may be appreciated based on a review of this disclosure. These changes and additions are intended to be within the scope and spirit of this invention as defined by the following claims.

What is claimed is:

1. A foldable blank for assembling a carton, said blank comprising:

(a) cover, top, rear, bottom and front panels hingedly connected in the order named, said cover, top, rear, bottom and front panels each having left and right ends, and said front panel further having a first edge free of a first lip portion and said top panel being hingedly connected to said cover panel by way of a first fold line;

(b) left and right bottom panel end flaps hingedly connected to said left and right ends of said bottom panel, said left bottom panel end flap having a second edge free of a second lip portion and said right bottom panel end flap having a feed gate engaging notch and a third edge free of a third lip portion;

(c) left and right front panel end flaps hingedly connected to said left and right ends of said front panel, said left front panel end flap having a fourth edge free of a fourth lip portion and said right front panel end flap having a fifth edge free of a fifth lip portion;

(d) left and right top panel end flaps hingedly connected to said left and right ends of said top panel by way of second and third fold lines, respectively;

(e) left and right rear panel end flaps hingedly connected to said left and right ends of said rear panel;

(f) left and right cover panel end flaps hingedly connected to said left and right ends of said cover panel;

wherein said blank is designed to form a carton, said carton assembled by the left bottom panel end flap being folded first, said left front panel end flap is folded second to overlie a portion of said left bottom panel end flap, said left top panel end flap is folded third, said left rear panel end flap is folded fourth, and wherein said right bottom panel end flap is folded first, said right front panel end flap is folded second to overlie a portion of said right bottom panel end flap, said right top panel end flap is folded third, said right rear panel end flap is folded fourth, and wherein said first free edge engages said first fold line, said second and fourth free edges engage said second fold line, said third and fifth free edges engage said third fold line.

2. The blank of claim 1, wherein said left and right rear panel end flaps each comprise a breakaway portion defined by a line of weakness formed in said blank.

3. The blank of claim 2, wherein said cover panel comprises a releasably secured tear strip defined by an upper and lower line of weakness formed in said blank.

4. The blank of claim 3, wherein said score lines and said lines of weakness are formed in the same direction with reference to the plane of the blank.

5. A foldable blank for assembling a carton, said blank comprising:

(a) cover, top, rear, bottom and front panels hingedly connected in the order named, said cover, top, rear, bottom and front panels each having left and right ends, and said front panel further having a first edge free of a first lip portion and said top panel being hingedly connected to said cover panel by way of a first fold line;

(b) left and right bottom panel end flaps hingedly connected to said left and right ends of said bottom panel, said left bottom panel end flap having a feed gate engaging notch and a second edge free of a second lip portion and said right bottom panel end flap having a third edge free of a third lip portion;

(c) left and right front panel end flaps hingedly connected to said left and right ends of said front panel, said left front panel end flap having a fourth edge free of a fourth lip portion and said right front panel end flap having a fifth edge free of a fifth lip portion;

(d) left and right top panel end flaps hingedly connected to said left and right ends of said top panel by way of second and third fold lines, respectively;

(e) left and right rear panel end flaps hingedly connected to said left and right ends of said rear panel;

(f) left and right cover panel end flaps hingedly connected to said left and right ends of said cover panel;

wherein said blank is designed to form a carton, said carton assembled by the left bottom panel end flap being folded first, said left front panel end flap is folded second to overlie a portion of said left bottom panel end flap, said left top panel end flap is folded third, said left rear panel end flap is folded fourth, and wherein said right bottom panel end flap is folded first, said right front panel end flap is folded second to overlie a portion of said right bottom panel end flap, said right top panel end flap is folded third, said right rear panel end flap is folded fourth, and wherein said first free edge engages said first fold line, said second and fourth free edges engage said second fold line, said third and fifth free edges engage said third fold line.

6. The blank of claim 5, wherein said left and right rear panel end flaps each comprise a breakaway portion defined by a line of weakness formed in said blank.

7. The blank of claim 6, wherein said cover panel comprises a releasably secured tear strip defined by an upper and lower line of weakness formed in said blank.

8. The blank of claim 7, wherein said score lines and said lines of weakness are formed in the same direction with reference to the plane of the blank.

9. A foldable blank for assembling a carton, said blank comprising:

(a) cover, top, rear, bottom and front panels hingedly connected in the order named, said cover, top, rear, bottom and front panels each having left and right ends, and said front panel further having a first edge free of a first lip portion and said top panel being hingedly connected to said cover panel by way of a first fold line;

(b) left and right bottom panel end flaps hingedly connected to said left and right ends of said bottom panel, said left bottom panel end flap having a second edge free of a second lip portion and said right bottom panel end flap having a third edge free of a third lip portion;

(c) left and right front panel end flaps hingedly connected to said left and right ends of said front panel, said left front panel end flap having a fourth edge free of a fourth lip portion and said right front panel end flap having a feed gate engaging notch and a fifth edge free of a fifth lip portion;

(d) left and right top panel end flaps hingedly connected to said left and right ends of said top panel by way of second and third fold lines, respectively;

(e) left and right rear panel end flaps hingedly connected to said left and right ends of said rear panel;

(f) left and right cover panel end flaps hingedly connected to said left and right ends of said cover panel;

wherein said blank is designed to form a carton, said carton assembled by the left bottom panel end flap being folded first, said left front panel end flap is folded second to overlie a portion of said left bottom panel end flap, said left top panel end flap is folded third, said left rear panel end flap is folded fourth, and wherein said right bottom panel end flap is folded first, said right front panel end flap is folded second to overlie a portion of said right bottom panel end flap, said right top panel end flap is folded third, said right rear panel end flap is folded fourth, and wherein said first free edge engages said first fold line, said second and fourth free edges engage said second fold line, said third and fifth free edges engage said third fold line.

10. The blank of claim 9, wherein said left and right rear panel end flaps each comprise a breakaway portion defined by a line of weakness formed in said blank.

11. The blank of claim 10, wherein said cover panel comprises a releasably secured tear strip defined by an upper and lower line of weakness formed in said blank.

12. The blank of claim 11, wherein said score lines and said lines of weakness are formed in the same direction with reference to the plane of the blank.

13. A foldable blank for assembling a carton, said blank comprising:

(a) cover, top, rear, bottom and front panels hingedly connected in the order named, said cover, top, rear, bottom and front panels each having left and right ends, and said front panel further having a first edge free of a first lip portion and said top panel being hingedly connected to said cover panel by way of a first fold line;

(b) left and right bottom panel end flaps hingedly connected to said left and right ends of said bottom panel, said left bottom panel end flap having a second edge free of a second lip portion and said right bottom panel end flap having a third edge free of a third lip portion;

(c) left and right front panel end flaps hingedly connected to said left and right ends of said front panel, said left front panel end flap having a feed gate engaging notch and a fourth edge free of a fourth lip portion and said right front panel end flap having a fifth edge free of a fifth lip portion;

(d) left and right top panel end flaps hingedly connected to said left and right ends of said top panel by way of second and third fold lines, respectively;

(e) left and right rear panel end flaps hingedly connected to said left and right ends of said rear panel;

(f) left and right cover panel end flaps hingedly connected to said left and right ends of said cover panel;

wherein said blank is designed to form a carton, said carton assembled by the left bottom panel end flap being folded first, said left front panel end flap is folded second to overlie a portion of said left bottom panel end flap, said left top panel end flap is folded third, said left rear panel end flap is folded fourth, and wherein said right bottom panel end flap is folded first, said right front panel end flap is folded second to overlie a portion of said right bottom panel end flap, said right top panel end flap is folded third, said right rear panel end flap is folded fourth, and wherein said first free edge engages said first fold line, said second and fourth free edges engage said second fold line, said third and fifth free edges engage said third fold line.

14. The blank of claim 13, wherein said left and right rear panel end flaps each comprise a breakaway portion defined by a line of weakness formed in said blank.

15. The blank of claim 14, wherein said cover panel comprises a releasably secured tear strip defined by an upper and lower line of weakness formed in said blank.

16. The blank of claim 15, wherein said score lines and said lines of weakness are formed in the same direction with reference to the plane of the blank.

17. A foldable blank for assembling a carton, said blank comprising:

(a) cover, top, rear, bottom and front panels hingedly connected in the order named, said cover, top, rear, bottom and front panels each having left and right ends, and said front panel further having a first edge free of a first lip portion and said top panel being hingedly connected to said cover panel by way of a first fold line;

(b) left and right bottom panel end flaps hingedly connected to said left and right ends of said bottom panel, said left bottom panel end flap having a second edge free of a second lip portion and said right bottom panel end flap having a third edge free of a third lip portion;

(c) left and right front panel end flaps hingedly connected to said left and right ends of said front panel, said left front panel end flap having a fourth edge free of a fourth lip portion and said right front panel end flap having a fifth edge free of a fifth lip portion;

(d) left and right top panel end flaps hingedly connected to said left and right ends of said top panel by way of second and third fold lines, respectively;

(e) left and right rear panel end flaps hingedly connected to said left and right ends of said rear panel, said right rear panel end flap having a feed gate engaging notch;

(f) left and right cover panel end flaps hingedly connected to said left and right ends of said cover panel;

wherein said blank is designed to form a carton, said carton assembled by the left bottom panel end flap being folded first, said left front panel end flap is folded second to overlie a portion of said left bottom panel end flap, said left top panel end flap is folded third, said left rear panel end flap is folded fourth, and wherein said right bottom panel end flap is folded first, said right front panel end flap is folded second to overlie a portion of said right bottom panel end flap, said right top panel end flap is folded third, said right rear panel end flap is folded fourth, and wherein said first free edge engages said first fold line, said second and fourth free edges engage said second fold line, said third and fifth free edges engage said third fold line.

18. The blank of claim 17, wherein said left and right rear panel end flaps each comprise a breakaway portion defined by a line of weakness formed in said blank.

19. The blank of claim 18, wherein said cover panel comprises a releasably secured tear strip defined by an upper and lower line of weakness formed in said blank.

20. The blank of claim 19, wherein said score lines and said lines of weakness are formed in the same direction with reference to the plane of the blank.

21. A foldable blank for assembling a carton, said blank comprising:

(a) cover, top, rear, bottom and front panels hingedly connected in the order named, said cover, top, rear, bottom and front panels each having left and right ends, and said front panel further having a first edge free of a first lip portion and said top panel being hingedly connected to said cover panel by way of a first fold line;

(b) left and right bottom panel end flaps hingedly connected to said left and right ends of said bottom panel, said left bottom panel end flap having a second edge free of a second lip portion and said right bottom panel end flap having a third edge free of a third lip portion;

(c) left and right front panel end flaps hingedly connected to said left and right ends of said front panel, said left front panel end flap having a fourth edge free of a fourth lip portion and said right front panel end flap having a fifth edge free of a fifth lip portion;

(d) left and right top panel end flaps hingedly connected to said left and right ends of said top panel by way of second and third fold lines, respectively;

(e) left and right rear panel end flaps hingedly connected to said left and right ends of said rear panel, said left rear panel end flap having a feed gate engaging notch;

(f) left and right cover panel end flaps hingedly connected to said left and right ends of said cover panel;

wherein said blank is designed to form a carton, said carton assembled by the left bottom panel end flap being folded first, said left front panel end flap is folded second to overlie a portion of said left bottom panel end flap, said left top panel end flap is folded third, said left rear panel end flap is folded fourth, and wherein said right bottom panel end flap is folded first, said right front panel end flap is folded second to overlie a portion of said right bottom panel end flap, said right top panel end flap is folded third, said right rear panel end flap is folded fourth, and wherein said first free edge engages said first fold line, said second and fourth free edges engage said second fold line, said third and fifth free edges engage said third fold line.

22. The blank of claim 21, wherein said left and right rear panel end flaps each comprise a breakaway portion defined by a line of weakness formed in said blank.

23. The blank of claim 22, wherein said cover panel comprises a releasably secured tear strip defined by an upper and lower line of weakness formed in said blank.

24. The blank of claim 23, wherein said score lines and said lines of weakness are formed in the same direction with reference to the plane of the blank.

25. A foldable blank for assembling a carton, said blank comprising:

(a) cover, top, rear, bottom and front panels hingedly connected in the order named, said cover, top, rear, bottom and front panels each having left and right ends, and said front panel further having a first edge free of a first lip portion and said top panel being hingedly connected to said cover panel by way of a first fold line;

(b) left and right bottom panel end flaps hingedly connected to said left and right ends of said bottom panel, said left bottom panel end flap having a second edge free of a second lip portion and said right bottom panel end flap having a third edge free of a third lip portion;

(c) left and right front panel end flaps hingedly connected to said left and right ends of said front panel, said left front panel end flap having a fourth edge free of a fourth lip portion and said right front panel end flap having a fifth edge free of a fifth lip portion;

(d) left and right top panel end flaps hingedly connected to said left and right ends of said top panel by way of second and third fold lines, respectively, said right top panel end flap having a feed gate engaging notch;

(e) left and right rear panel end flaps hingedly connected to said left and right ends of said rear panel;

(f) left and right cover panel end flaps hingedly connected to said left and right ends of said cover panel;

wherein said blank is designed to form a carton, said carton assembled by the left bottom panel end flap being folded first, said left front panel end flap is folded second to overlie a portion of said left bottom panel end flap, said left top panel end flap is folded third, said left rear panel end flap is folded fourth, and wherein said right bottom panel end flap is folded first, said right front panel end flap is folded second to overlie a portion of said right bottom panel end flap, said right top panel end flap is folded third, said right rear panel end flap is folded fourth, and wherein said first free edge engages said first fold line, said second and fourth free edges engage said second fold line, said third and fifth free edges engage said third fold line.

26. The blank of claim 25, wherein said left and right rear panel end flaps each comprise a breakaway portion defined by a line of weakness formed in said blank.

27. The blank of claim 26, wherein said cover panel comprises a releasably secured tear strip defined by an upper and lower line of weakness formed in said blank.

28. The blank of claim 27, wherein said score lines and said lines of weakness are formed in the same direction with reference to the plane of the blank.

29. A foldable blank for assembling a carton, said blank comprising:

(a) cover, top, rear, bottom and front panels hingedly connected in the order named, said cover, top, rear, bottom and front panels each having left and right ends, and said front panel further having a first edge free of a first lip portion and said top panel being hingedly connected to said cover panel by way of a first fold line;

(b) left and right bottom panel end flaps hingedly connected to said left and right ends of said bottom panel, said left bottom panel end flap having a second edge free of a second lip portion and said right bottom panel end flap having a third edge free of a third lip portion;

(c) left and right front panel end flaps hingedly connected to said left and right ends of said front panel, said left front panel end flap having a fourth edge free of a fourth lip portion and said right front panel end flap having a fifth edge free of a fifth lip portion;

(d) left and right top panel end flaps hingedly connected to said left and right ends of said top panel by way of second and third fold lines, respectively, said left top panel end flap having a feed gate engaging notch;

(e) left and right rear panel end flaps hingedly connected to said left and right ends of said rear panel;

(f) left and right cover panel end flaps hingedly connected to said left and right ends of said cover panel;

wherein said blank is designed to form a carton, said carton assembled by the left bottom panel end flap being folded first, said left front panel end flap is folded second to overlie a portion of said left bottom panel end flap, said left top panel end flap is folded third, said left rear panel end flap is folded fourth, and wherein said right bottom panel end flap is folded first, said right front panel end flap is folded second to overlie a portion of said right bottom panel end flap, said right top panel end flap is folded third, said right rear panel end flap is folded fourth, and wherein said first free edge engages said first fold line, said second and fourth free edges engage said second fold line, said third and fifth free edges engage said third fold line.

30. The blank of claim 29, wherein said left and right rear panel end flaps each comprise a breakaway portion defined by a line of weakness formed in said blank.

31. The blank of claim 30, wherein said cover panel comprises a releasably secured tear strip defined by an upper and lower line of weakness formed in said blank.

32. The blank of claim 31, wherein said score lines and said lines of weakness are formed in the same direction with reference to the plane of the blank.

* * * * *